US011821710B2

(12) United States Patent
Faifer

(10) Patent No.: US 11,821,710 B2
(45) Date of Patent: Nov. 21, 2023

(54) TRIGGER SHROUD ASSEMBLY, SMALL ARMS APPARATUS, AND METHOD

(71) Applicant: Sagi Faifer, Mishmar Hashiva (IL)

(72) Inventor: Sagi Faifer, Mishmar Hashiva (IL)

( * ) Notice: Subject to any disclaimer, the term of this patent is extended or adjusted under 35 U.S.C. 154(b) by 0 days.

(21) Appl. No.: 17/888,431

(22) Filed: Aug. 15, 2022

(65) Prior Publication Data

US 2023/0175812 A1 Jun. 8, 2023

Related U.S. Application Data

(60) Provisional application No. 63/233,269, filed on Aug. 15, 2021.

(51) Int. Cl.
*F41C 33/02* (2006.01)
*F41C 33/04* (2006.01)

(52) U.S. Cl.
CPC ..... *F41C 33/0245* (2013.01); *F41C 33/0254* (2013.01); *F41C 33/0263* (2013.01); *F41C 33/041* (2013.01); *F41C 33/048* (2013.01)

(58) Field of Classification Search
CPC ..... F41C 33/0263; F41C 33/0254; F41C 33/0245; F41C 33/041; F41C 33/048
See application file for complete search history.

(56) References Cited

U.S. PATENT DOCUMENTS

| | | | | |
|---|---|---|---|---|
| 10,352,673 | B1 * | 7/2019 | Sitz | F41A 23/18 |
| 2012/0097718 | A1 * | 4/2012 | Baumann | F41C 33/0254 224/193 |
| 2013/0301243 | A1 * | 11/2013 | Rorick | F41G 1/00 362/110 |
| 2018/0321015 | A1 * | 11/2018 | Hedeen | F41G 1/35 |
| 2019/0249950 | A1 * | 8/2019 | Tedder | F41C 33/0263 |
| 2021/0333064 | A1 * | 10/2021 | Self | F41C 33/0245 |

* cited by examiner

*Primary Examiner* — Corey N Skurdal
(74) *Attorney, Agent, or Firm* — Law Office of Arthur M. Antonelli, PLLC

(57) ABSTRACT

A trigger shroud assembly (14) for a small arms weapon (12) is disclosed. The trigger shroud assembly (14) may include a rail mount (22), an accessory body (28) slidably connected to the rail mount, a spring guide (24) disposed between the rail mount and the accessory body, a resilient member (26) arranged about the spring guide, and a starboard side trigger shroud (32) and a port side trigger shroud (34) connected to the accessory body. A belt clip (36) may be disposed on one of the starboard side trigger shroud or the port side trigger shroud. The trigger shroud assembly (14) may include a closed configuration (17) and an open configuration (27). The trigger shroud assembly (14) may include a tactical accessory (47) such as a flashlight. The trigger shroud assembly (14) may be secured to a handgun for inside the waistband carry and to deter inadvertent handgun discharge.

8 Claims, 25 Drawing Sheets

FIG. 19
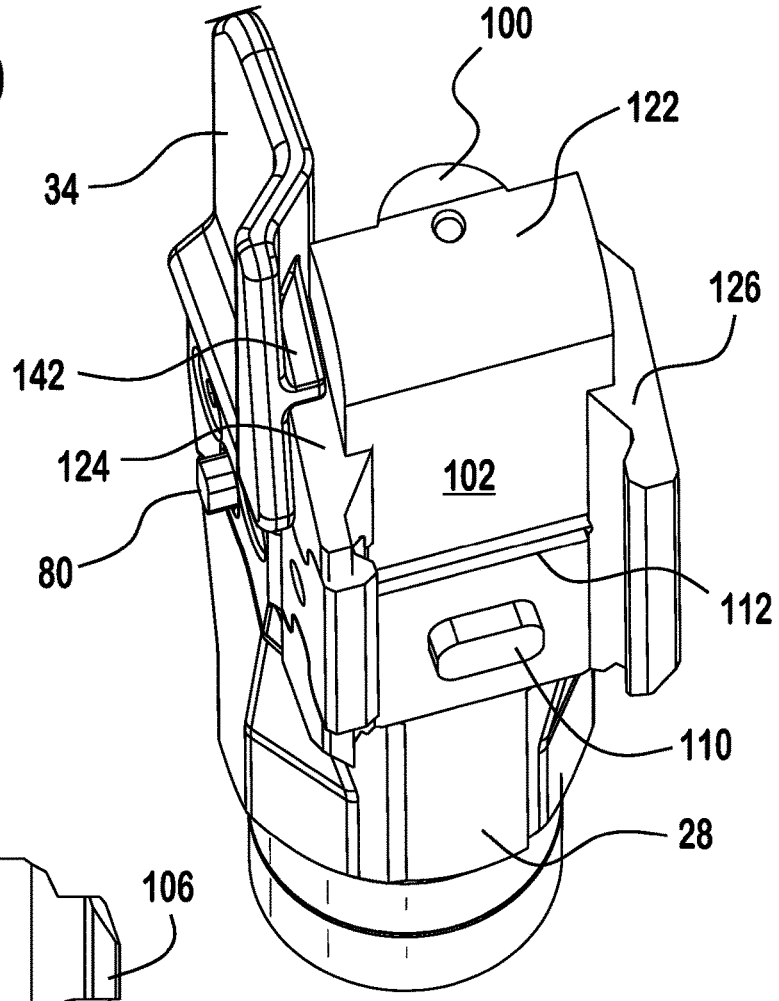
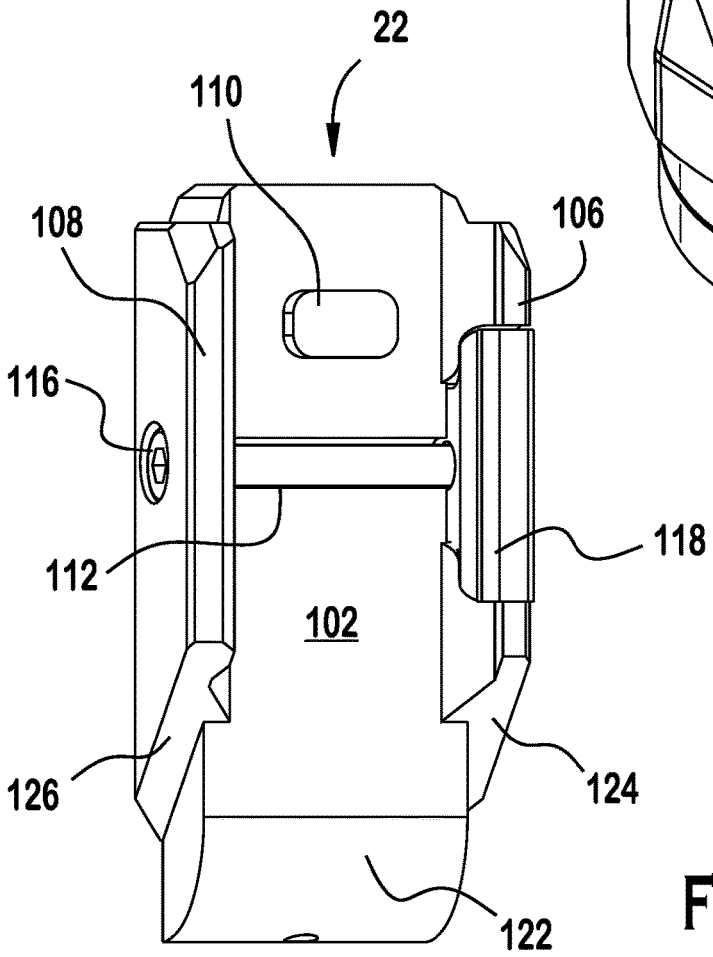
FIG. 20

TRIGGER SHROUD ASSEMBLY, SMALL ARMS APPARATUS, AND METHOD

CROSS REFERENCE TO RELATED APPLICATIONS

This application claims the benefit of U.S. Provisional Application No. 63/233,269 filed Aug. 15, 2021, which is incorporated by reference herein in its entirety.

FIELD OF THE INVENTION

The invention generally relates to a device or apparatus for wearing or carrying small arms. More particularly, the invention relates to a rail mounted accessory body and trigger shroud for a handgun.

BACKGROUND

Devices for wearing or carrying small arms are known in the related art, including skeleton holsters which may contact only a part of the small arm such as the muzzle, ejection port, chamber, trigger guard or hammer. These devices may be used to carry a small arm inside an operator's waistband.

SUMMARY

Hence, the present disclosure is directed toward a rail mounted accessory body and trigger shroud that may be secured to a small arms weapon and carried inside an operator's waist band or handbag. For instance, a trigger shroud assembly for a small arms weapon having a frame that includes an accessory rail and a trigger guard is disclosed. The trigger shroud assembly may include a rail mount, The rail mount may include a block with a superior portion and an inferior portion. The superior portion may be configured and dimensioned to interlock with the accessory rail of a handgun frame. The inferior portion may include an inferior starboard side rail that includes a first inclined face, an inferior port side rail that includes a second inclined face, a tab adjacent to the starboard side rail and the port side rail, and a recessed track abutting the inferior starboard side rail, the inferior port side rail, and the tab. The inferior portion of the block further may include a catch on one of the starboard side rail or the port side rail. The trigger shroud assembly may further include an accessory body slidably connected to the inferior portion, a spring guide disposed between the tab and the accessory body, a resilient member arranged about the spring guide, and a starboard side trigger shroud connected to the accessory body, the starboard side trigger shroud including a starboard stop. Additionally, the trigger shroud assembly may include a port side trigger shroud connected to the accessory body, the port side trigger shroud including a port side stop, as well as a belt clip disposed on the other one of the starboard side rail or the port side rail. The trigger shroud assembly may include a closed configuration and an open configuration such that in the closed configuration the accessory body is adjacent to the tab, and in the open configuration the starboard stop is adjacent to the first inclined face, the port side stop is adjacent to the second inclined face, and the resilient member biases the accessory body away from the tab.

DESCRIPTION OF THE DRAWINGS

In the accompanying drawings, which form part of this specification and are to be read in conjunction therewith and in which like reference numerals are used to indicate like parts in the various views:

FIG. 19. is a rear right perspective view of the rail mount and the shroud and distal housing of FIG. 18, a catch on the shroud being engaged with an inclined surface on the rail mount to block forward travel of the shroud and distal housing;

FIG. 20. is a rear right perspective view of the superior surface of the rail mount of FIG. 1;

DESCRIPTION

Figure 1:
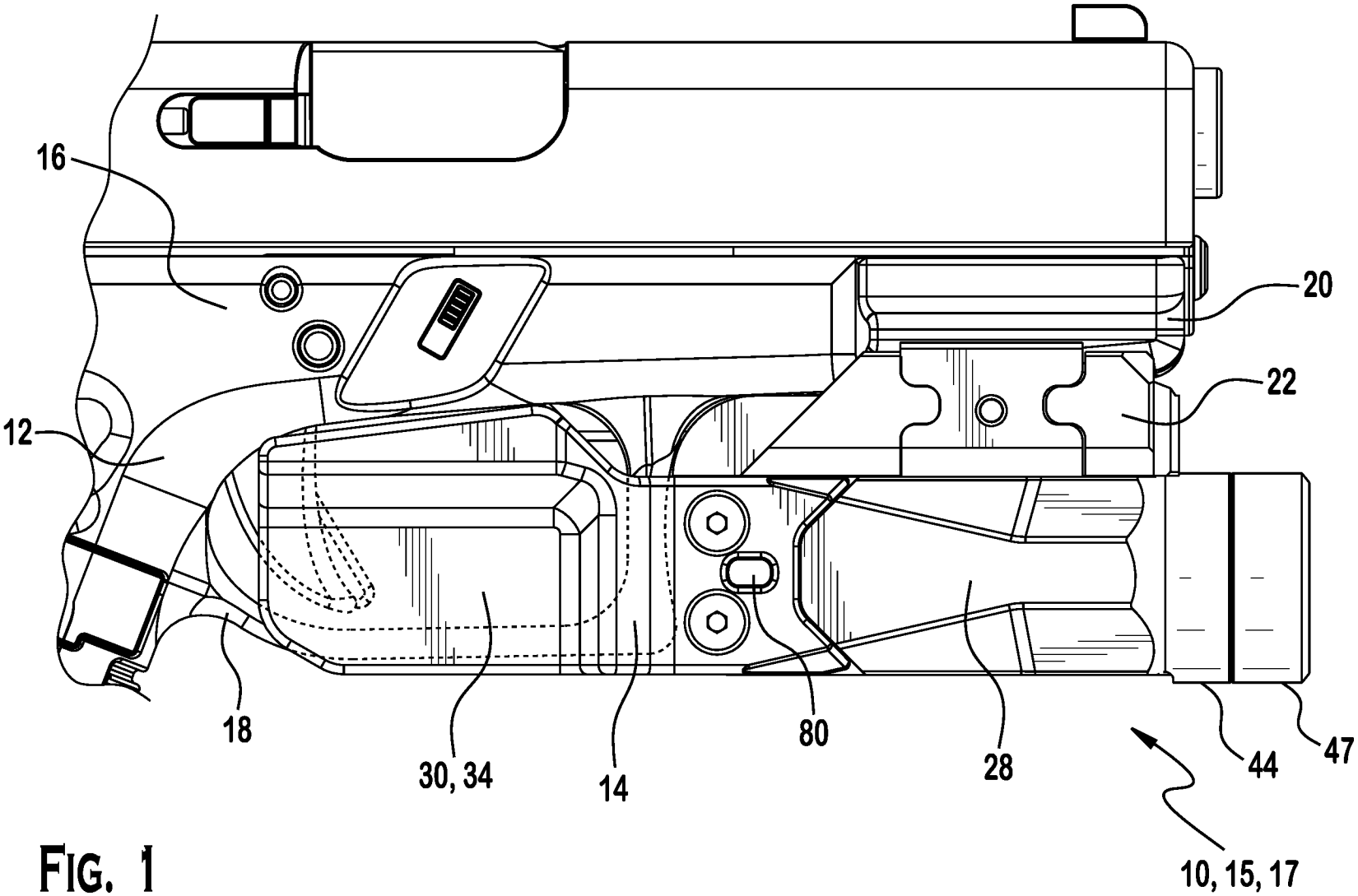
FIG. 1 is a left side view of an exemplary small arms apparatus in a stored configuration, the small arms apparatus includes a trigger shroud assembly, the trigger shroud assembly being in a closed configuration.
Figure 8:
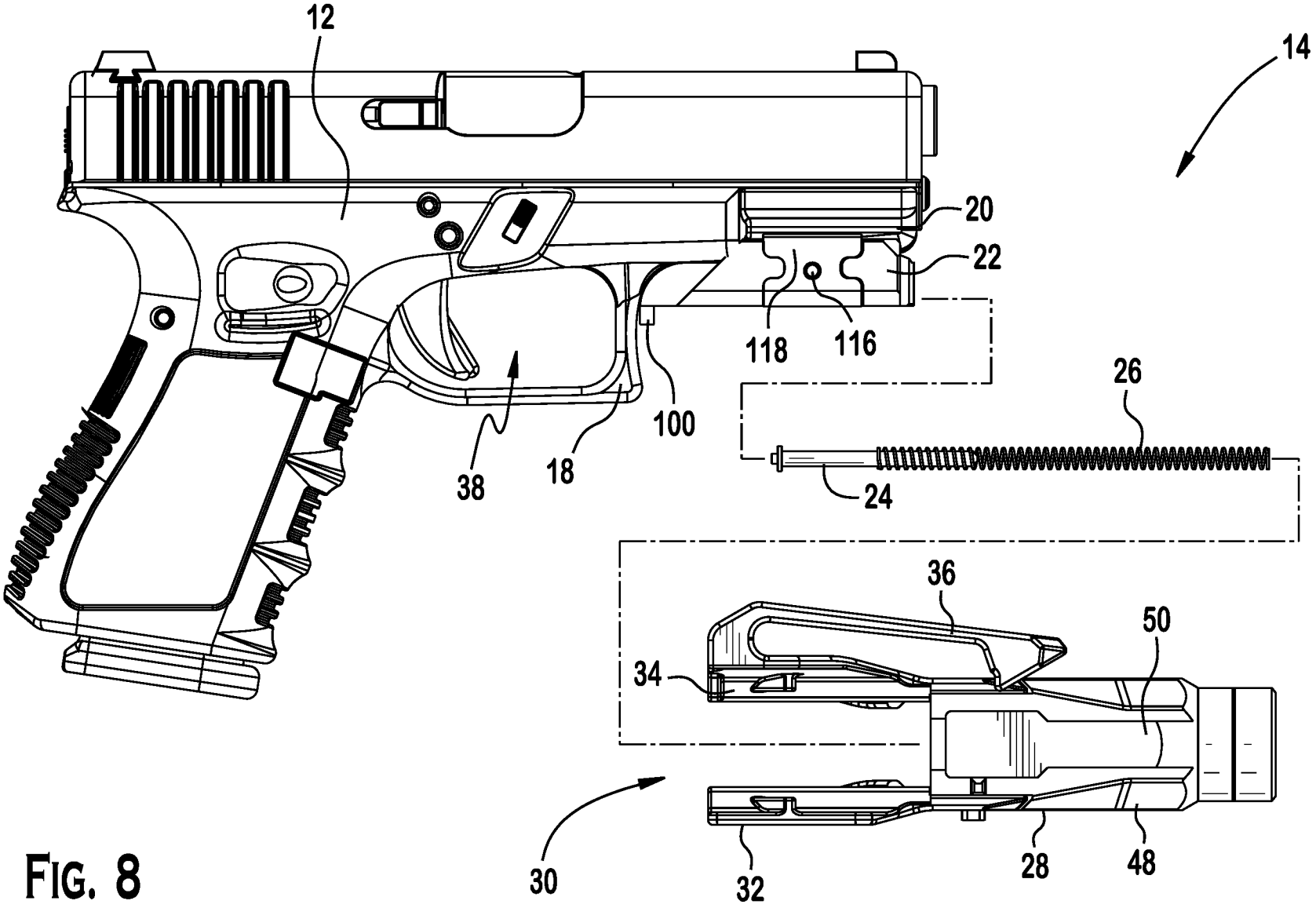
FIG. 8 is a plan view of the small arms apparatus of FIG. 1 in a state of partial disassembly.

FIG. 1 is a left side view of an exemplary small arm apparatus 10. The small arm apparatus 10 may include a small arm 12 and a trigger shroud assembly 14. In FIG. 1, the small arm apparatus 10 is shown in a stored configuration 15, the trigger shroud assembly being in a closed configuration 17. Referring to FIG. 8, the small arm 12 may be a handgun (e.g., a pistol) with a frame 16 that includes a trigger guard 18 and an accessory rail section (e.g., a Picatinny rail) 20 forward of the trigger guard. The trigger shroud assembly 14 may include a rail mount 22, a spring guide 24, a resilient member (e.g., a coil spring) 26, an accessory body 28 and a trigger shroud 30. The trigger shroud 30 may include a starboard shroud 32 and a port shroud 34. Preferably either the starboard shroud 32 or the port shroud 34 may include a belt clip 36. Generally, a right dominant handed operator may prefer that a belt clip 36 be associated with the starboard shroud 32; whereas, a left dominant handed operator may prefer that a belt clip 36 be associated with the port shroud 34.

Figure 2:
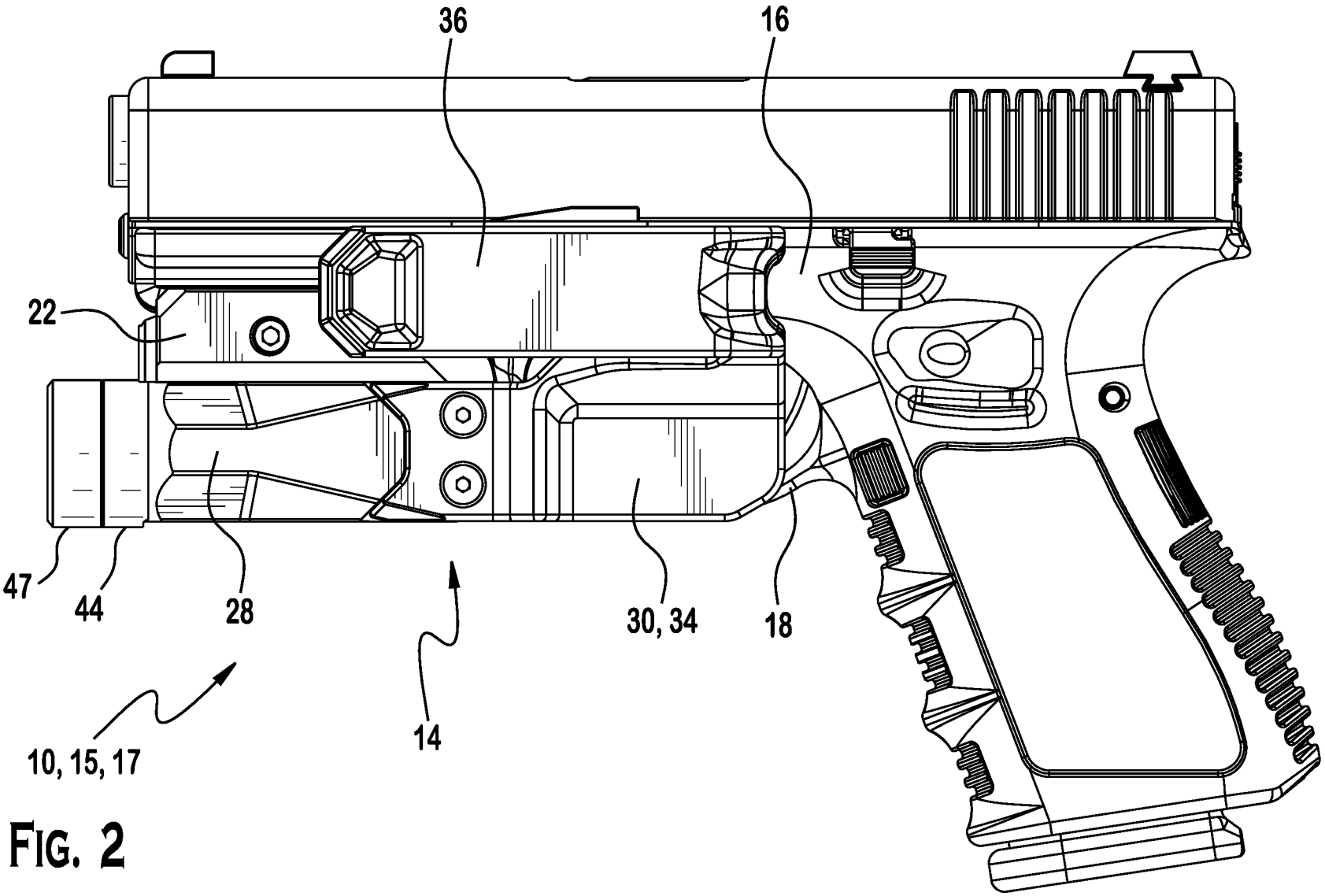
FIG. 2 is a right side view of the small arms apparatus of FIG. 1.
Figure 3:
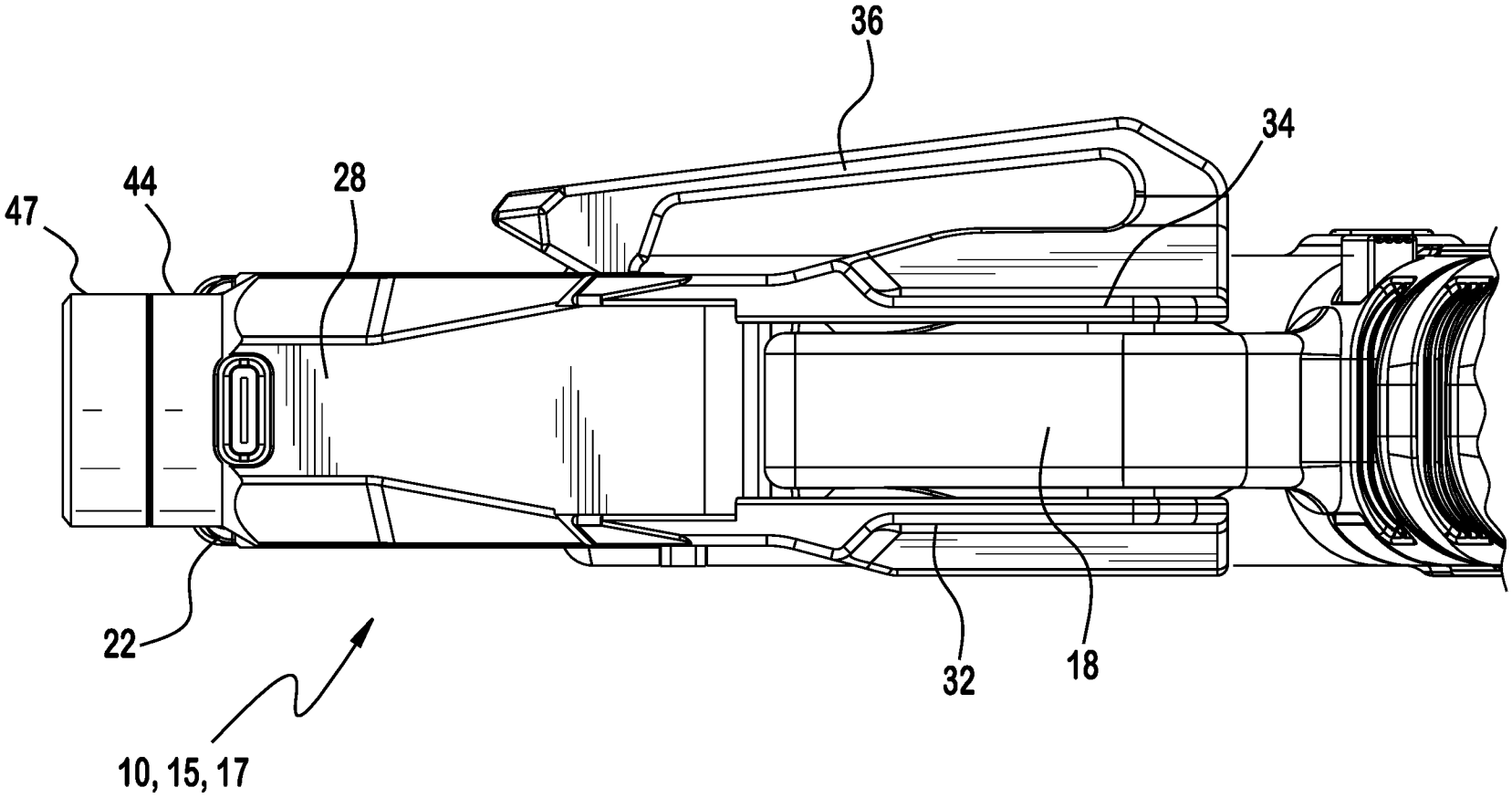
FIG. 3 is a bottom view of the small arms apparatus of FIG. 1.
Figure 4:
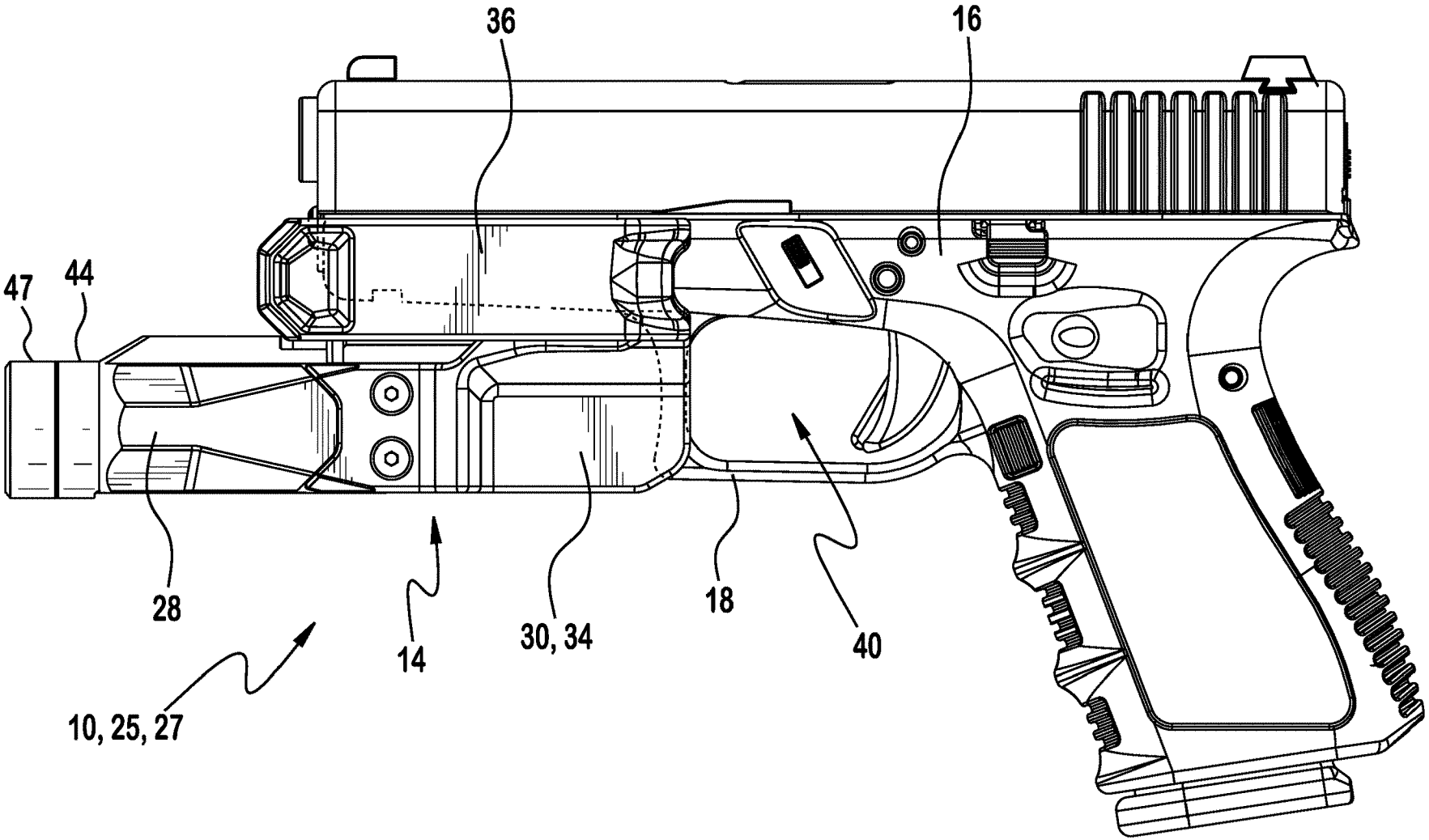
FIG. 4 is a right side view of the small arms apparatus of FIG. 1 in a deployed configuration, the trigger shroud assembly being in an open configuration.
Figure 5:
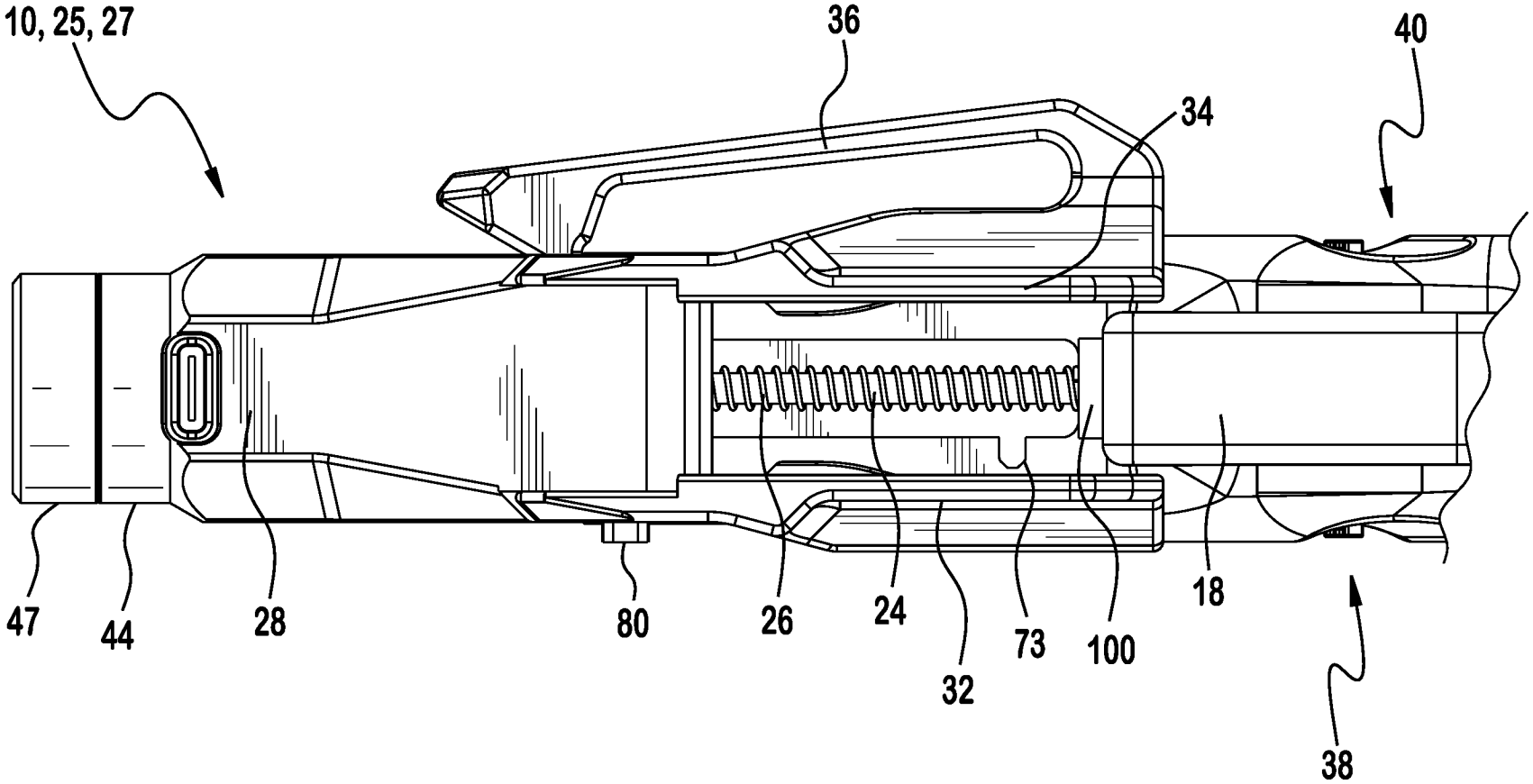
FIG. 5 is bottom view of the small arms apparatus of FIG. 4.
Figure 6:
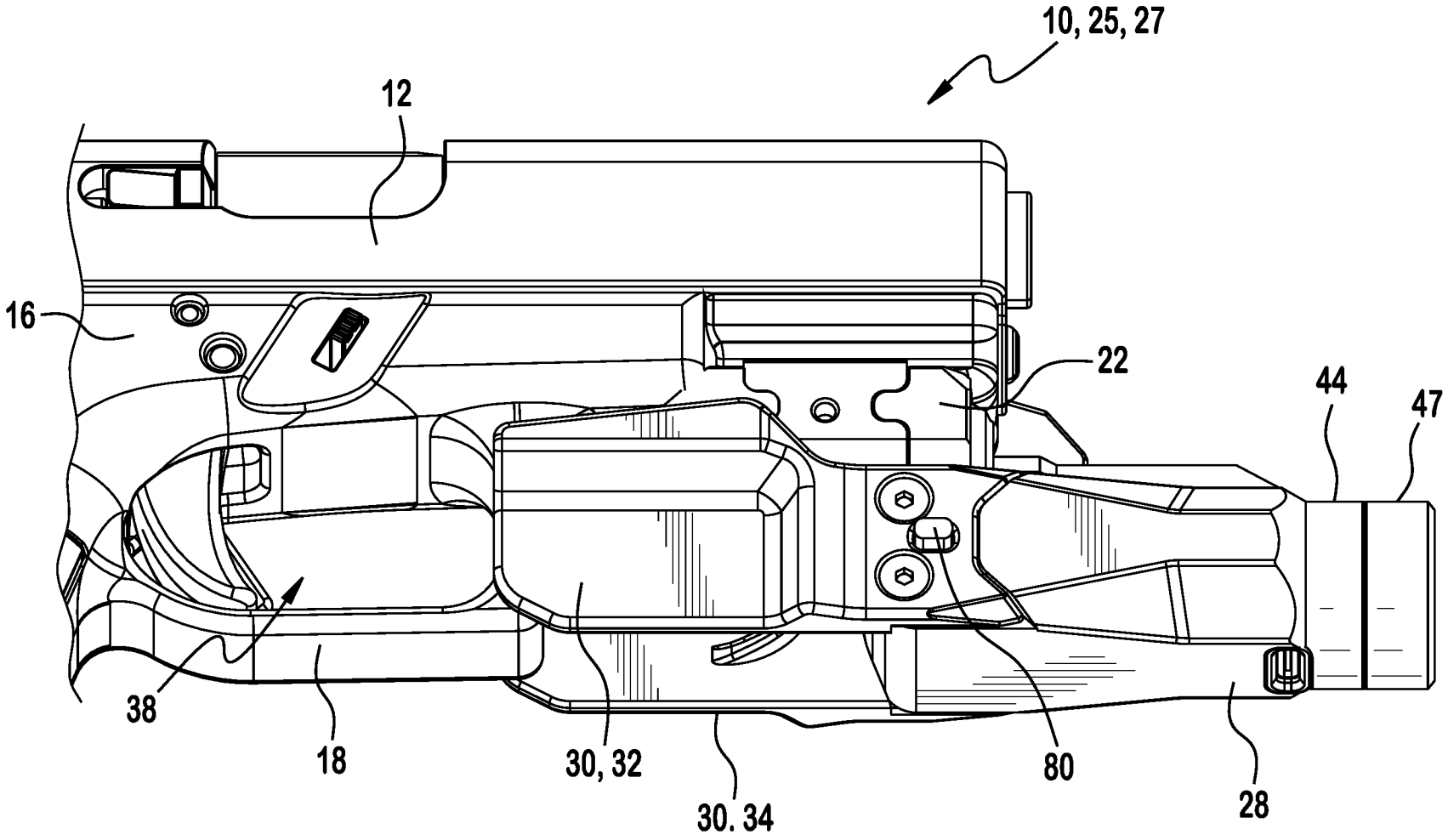
FIG. 6 is left side perspective view of the small arms apparatus of FIG. 4.

Referring to FIG. 1, FIG. 2, and FIG. 3, the belt clip 36 may be associated with the port shroud 34. In the stored configuration 15 the starboard shroud 32 may cover the right side trigger guard opening 38 and the port shroud 34 may cover the left side trigger guard opening 40. In the stored configuration 15, the starboard shroud 32 and the port shroud 34 may isolate the trigger 42 to deter inadvertent activation of the small arms weapon 12.

By contrast, in FIG. 4, FIG. 5, FIG. 6 and FIG. 7, the small arm apparatus 10 is shown in a deployed configuration 25, the trigger shroud assembly being in an open configuration 27. In the deployed configuration 25, the starboard shroud 32 and the port shroud 34 may be spaced from the side trigger guard openings 38, 40 to allow unobstructed access to the trigger 42 from the right side trigger guard opening 38 and/or the left side trigger guard opening 40. Preferably, the starboard shroud 32 and the port shroud 34 are arranged in front of the side trigger guard openings 38, 40.

Figure 7:
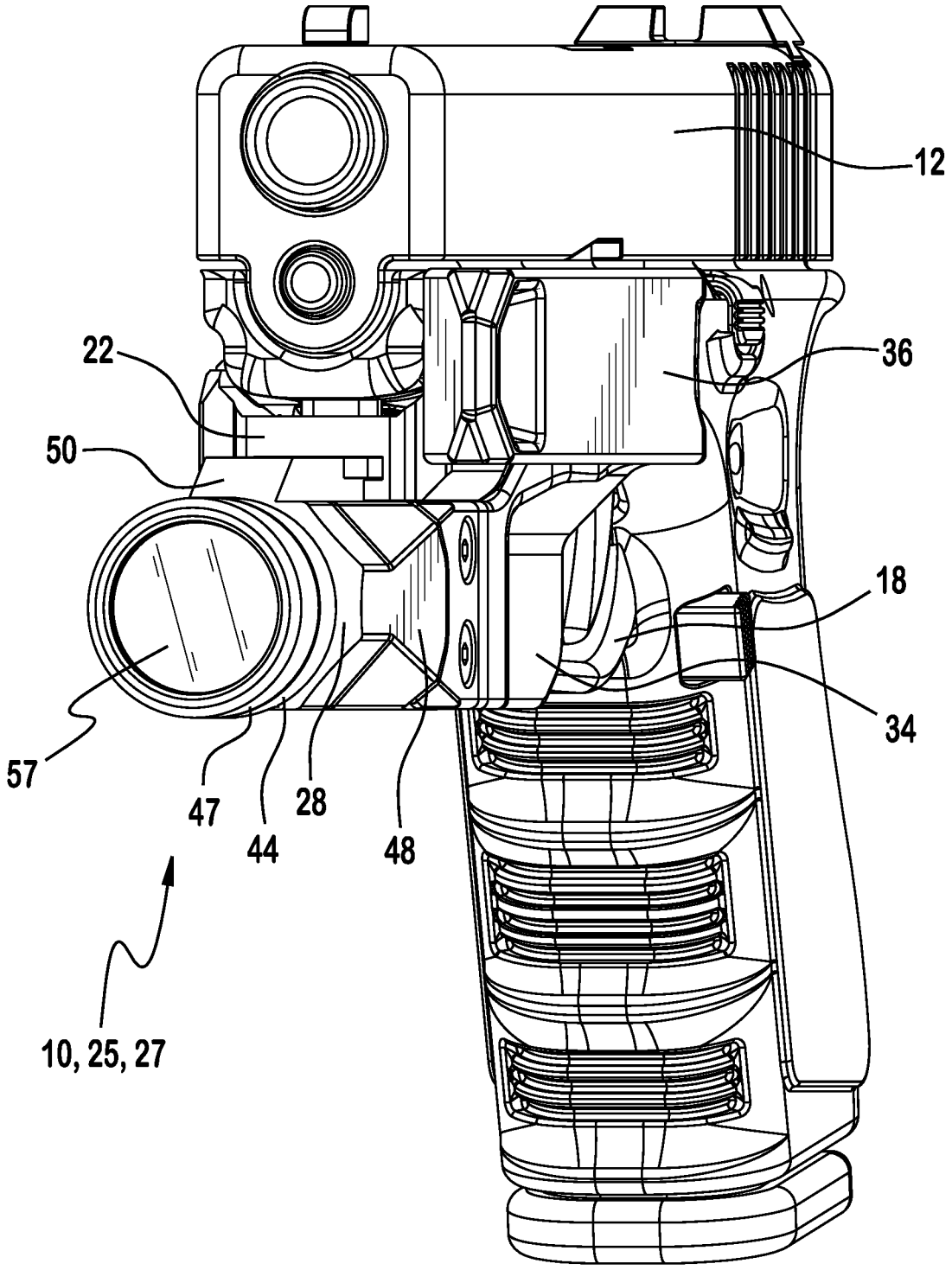
FIG. 7 is a front right side perspective view of the small arms apparatus of FIG. 4.
Figure 11:
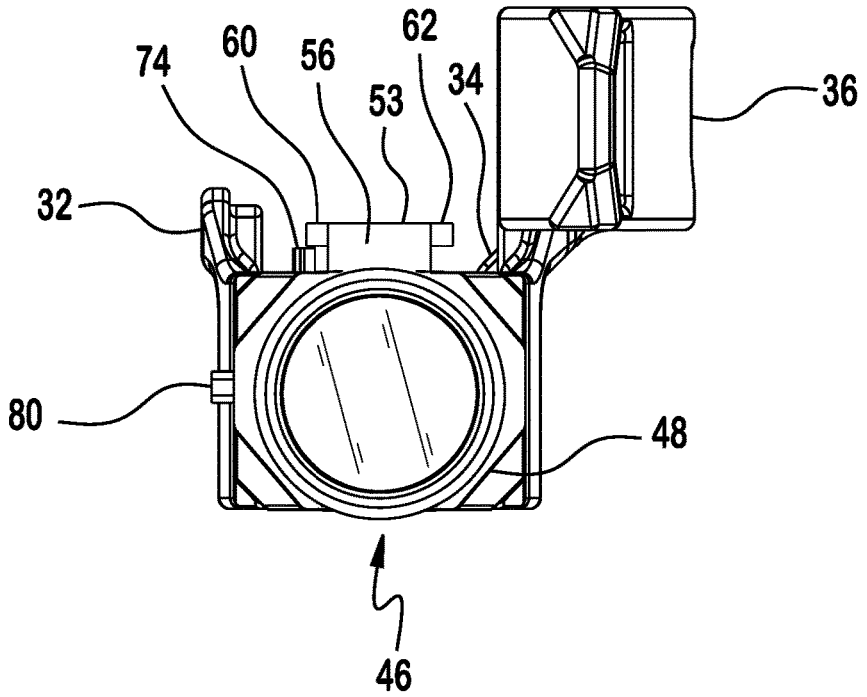
FIG. 11 is a front view of the trigger shroud and distal housing of FIG. 9.
Figure 34:
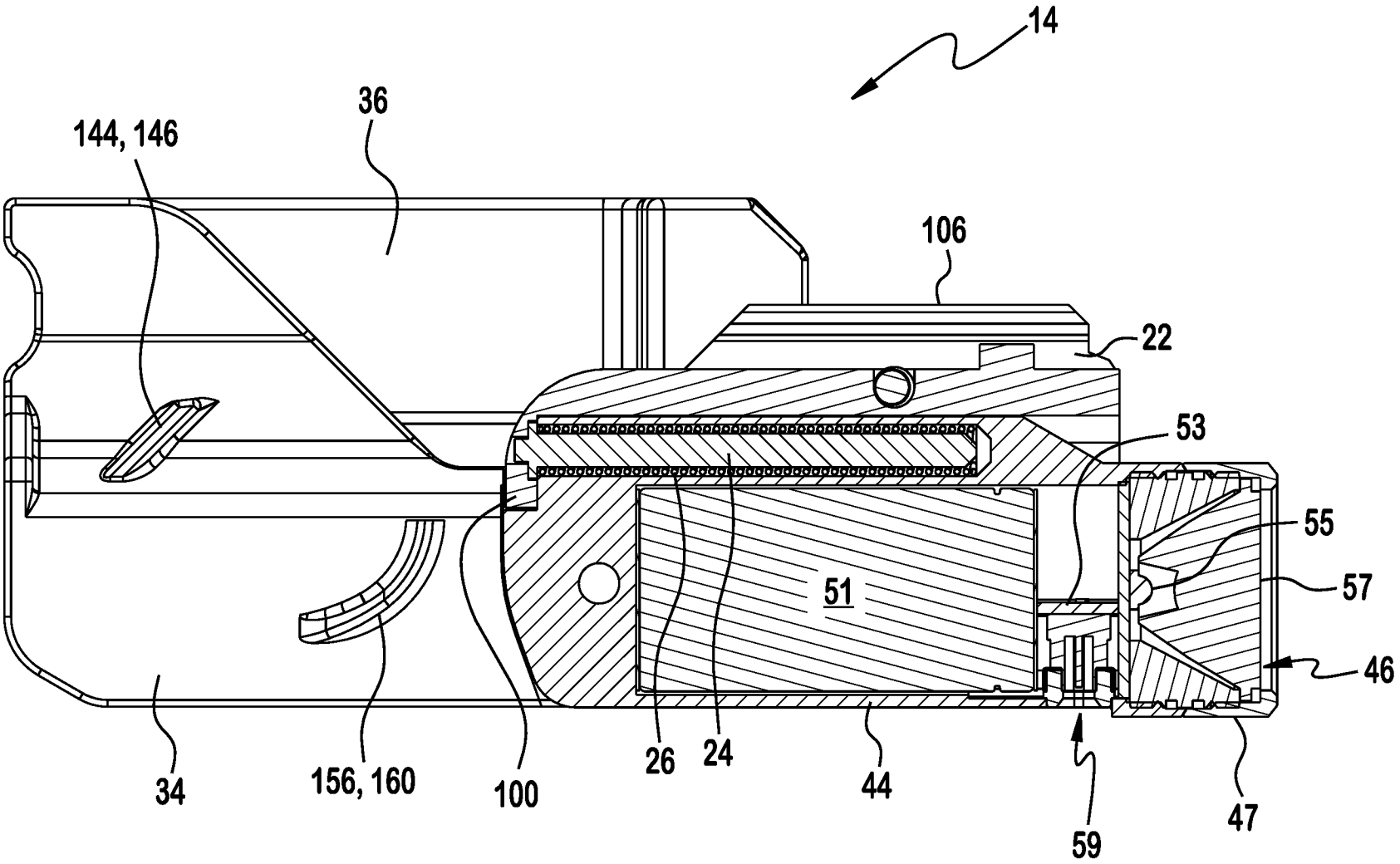
FIG. 34 is a cross-sectional view of the trigger shroud assembly of FIG. 11 along line 34-34, the trigger shroud assembly being shown in the stored (or closed) configuration.
Figure 35:
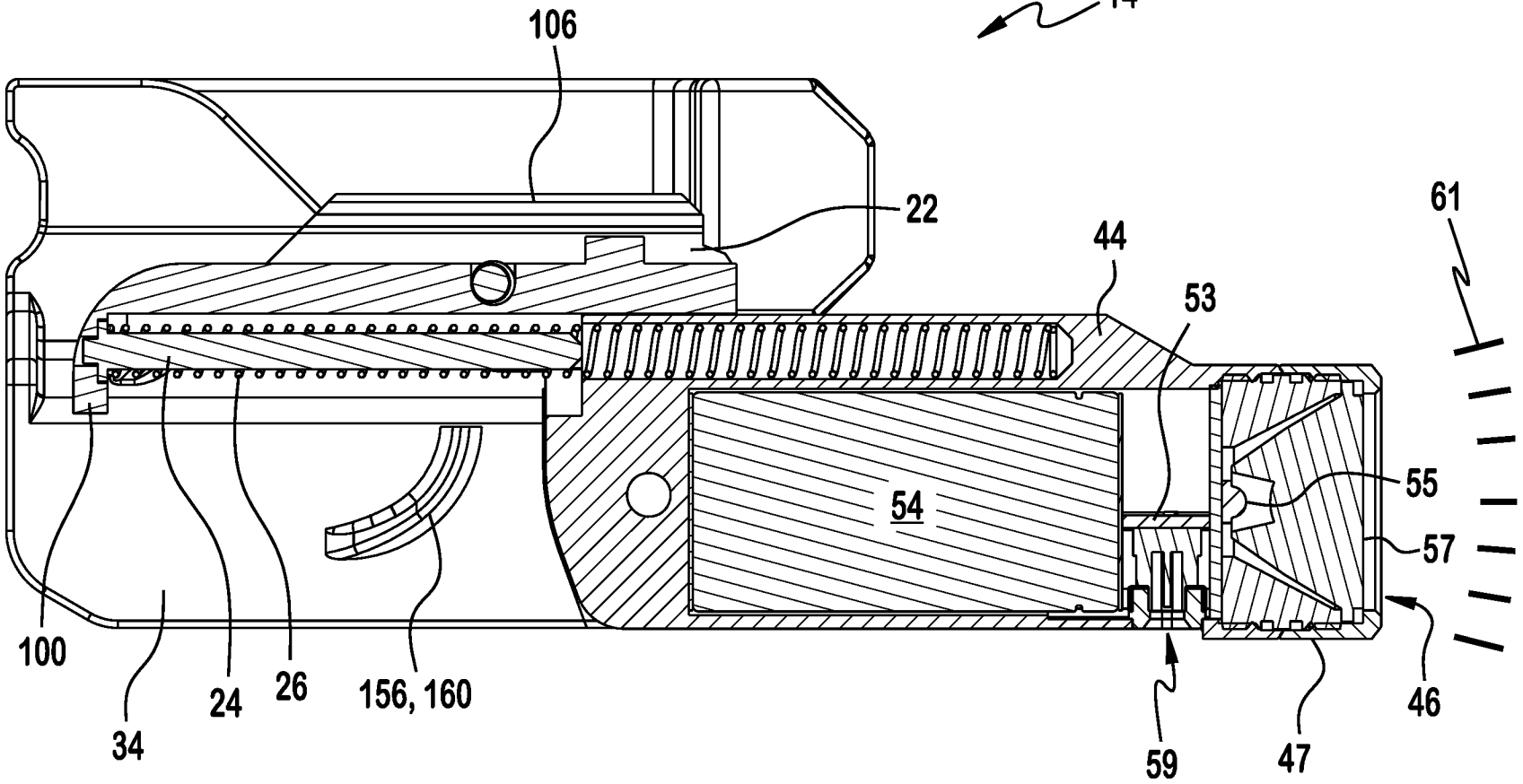
FIG. 35 is a cross-sectional view of the trigger shroud assembly of FIG. 11 along line 34-34, the trigger shroud assembly being shown in the deployed (or open) configuration.

As shown in FIG. 7 and FIG. 11, the accessory body 28 may include a distal housing 44 for a tactical accessory 47. For instance, as shown in FIG. 34 and FIG. 35. the distal housing 44 may include a receptacle 46 for receiving a flashlight, a laser pointer, or other powered device. For instance, the receptacle 46 may receive a power supply 51, a control circuit 53, and an active semiconductor device 55 (e.g., a light emitting diode), and a lens 57. The receptacle 46 may further house a port 59 for electrically connecting the power supply 51 or control circuit 53 to an external device (e.g., power source, a general purpose computer, a mobile phone or a wireless network).

The control circuit may be in mechanical or electrical communication with a switch or sensor that cooperates with the control circuit to selectively control operation of the tactical accessory. For instance, a sensor may detect the position of the distal housing with respect to the trigger shroud, and the control circuit may activate the tactical accessory when the trigger shrouds assembly is in the open configuration 27 and deactivate the tactical accessory when the trigger shroud assembly is in the closed configuration 17.

Referring to FIG. 34 and FIG. 35, the tactical accessory 47 may be a flashlight that is automatically turned off in the closed configuration 17 and automatically turned on to emit light 61 in the open configuration 27. More particularly, the light emitting diode may be a single-die packaged light emitting diode. Generally, the light emitting diode may have a light output substantially equal to or greater than 300 lumens as measured by ANSI FL 1-2009 Standard. Also, the light emitting diode may have a light output substantially equal to or greater than 1000 lumens as measured by ANSI FL 1-2009 Standard. Further still, the primary lamp further may have a light output substantially equal to or greater than 2000 lumens as measured by ANSI FL 1-2009 Standard.

For example, the flashlight may include an XLamp® XM-L2 LED manufactured by Cree, Inc. of Durham, NC, and which may deliver approximately 1198 lumens (lm) at 116 lumens-per-watt (LPW) efficacy at 3 A, 25° C. See Product Family Data Sheet, CLD-DS61 REV 4, published by Cree, Inc., which describes the characteristics and mechanical dimensions of the XM-L2 LED. In this example, the flashlight may produce a luminous flux ranging from approximately 160 lm to approximately 1200 lm, operating at a lamp current ranging from approximately 100 mA to approximately 3000 mA, and operating at a typical forward voltage ranging from approximately 2.6 V to approximately 3.4 V. In another example, the flashlight may include an XLamp® MT-G2 P0 LED (5000K, 25 tep) manufactured by Cree, Inc. of Durham, NC, which may deliver a light output of substantially equal to or greater than 2750 lumens. See Product Family Data Sheet, CLD-DS49 REV 2B, published by Cree, Inc., which describes the characteristics and mechanical dimensions of the MT-G2 LED. In this example, the operating voltage of the flashlight may range from approximately 5 to approximately 20 volts.

Generally, the battery type or configuration of the power supply for the tactical accessory may vary based on the requirements of the tactical accessory. For example, multiple CR123A batteries (e.g., 6 batteries) in series or NCR-18650 batteries (e.g., 3 batteries) in series may be used to power a flashlight. The size of the distal housing 44 and the receptacle 46 may be lengthened (or otherwise modified) to accommodate a power supply configuration of a particular tactical accessory.

Figure 9:
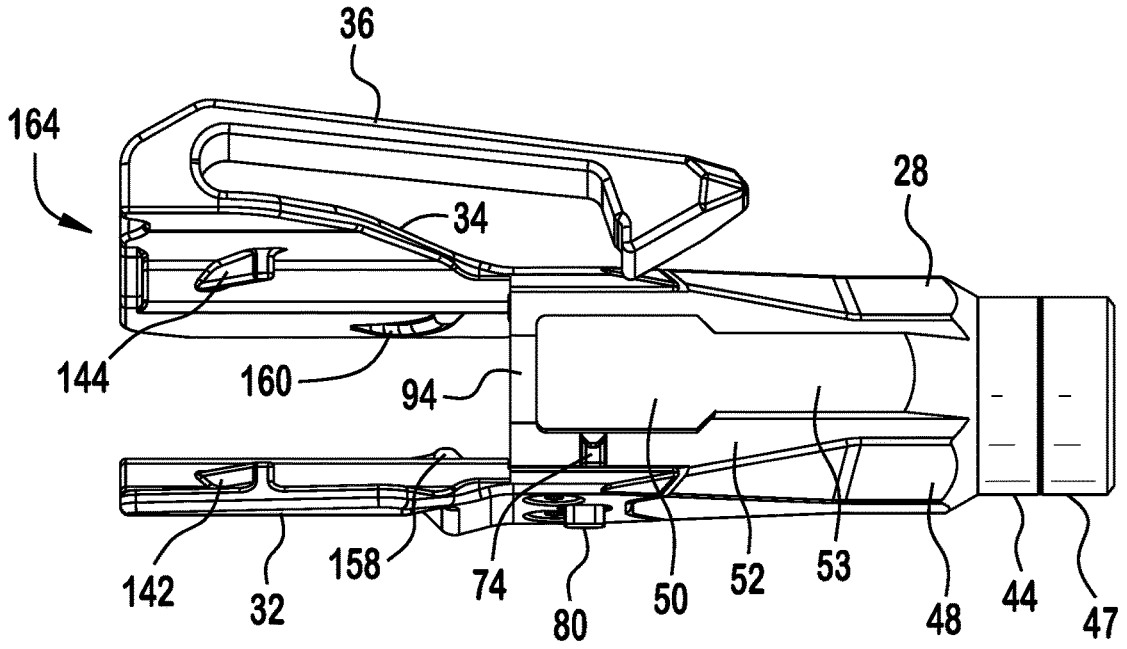
FIG. 9 is a top left side perspective view of the trigger shroud and distal housing of FIG. 8.
Figure 10:
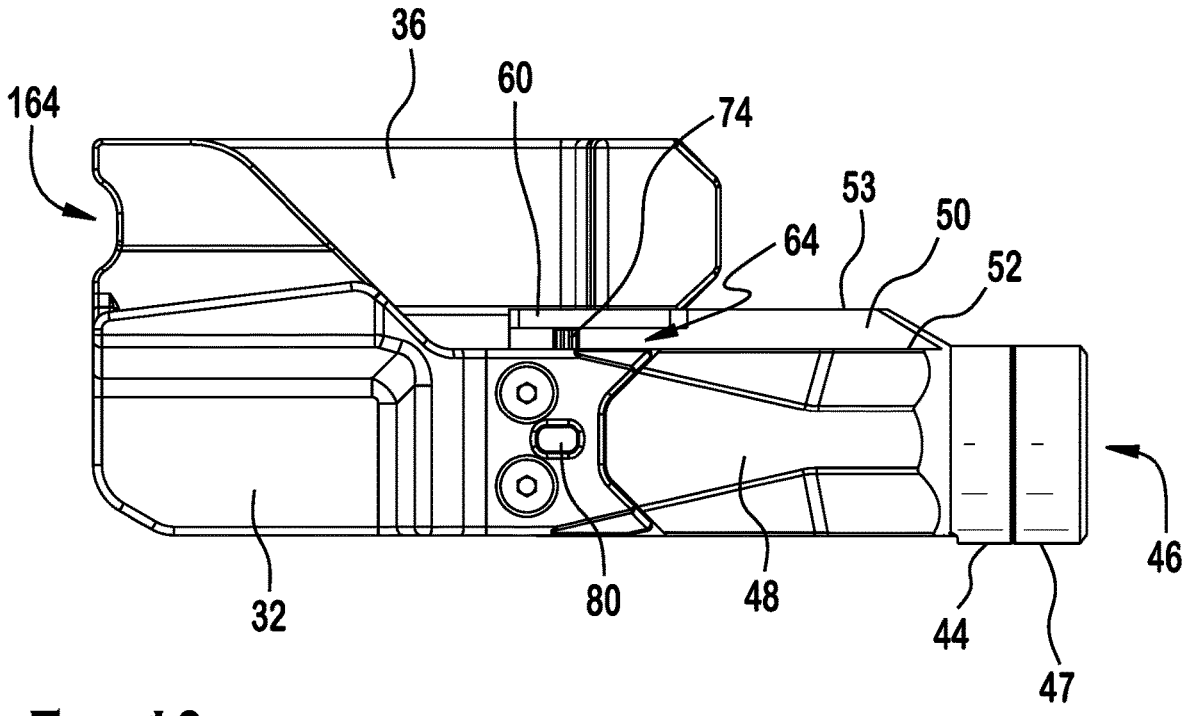
FIG. 10 is a left side view of the trigger shroud and distal housing of FIG. 9.

Referring to FIG. 9 and FIG. 10, the accessory body 28 may include an inferior base portion 48 and a superior plate portion 50. The inferior base portion 48 may include an upper surface 52. The superior plate portion 50 may be disposed on the upper surface 52 of the inferior base portion. The superior plate portion 50 further may include a rear face 54, a front face 56 and an axial bore 58 which extends from the rear face 54 to the front face 56. The superior plate portion 50 further may include a starboard ledge 60 and a port ledge 62. The starboard ledge 60 and the upper surface 52 of the inferior base portion 48 may define a starboard channel 64. The port ledge 62 and the upper surface 52 of the inferior base portion 48 may define a port channel 66. The starboard channel 64 may be parallel to the port channel 66. The starboard channel 64 and the port channel 66 may be aligned with the axial bore 58.

Figure 14:
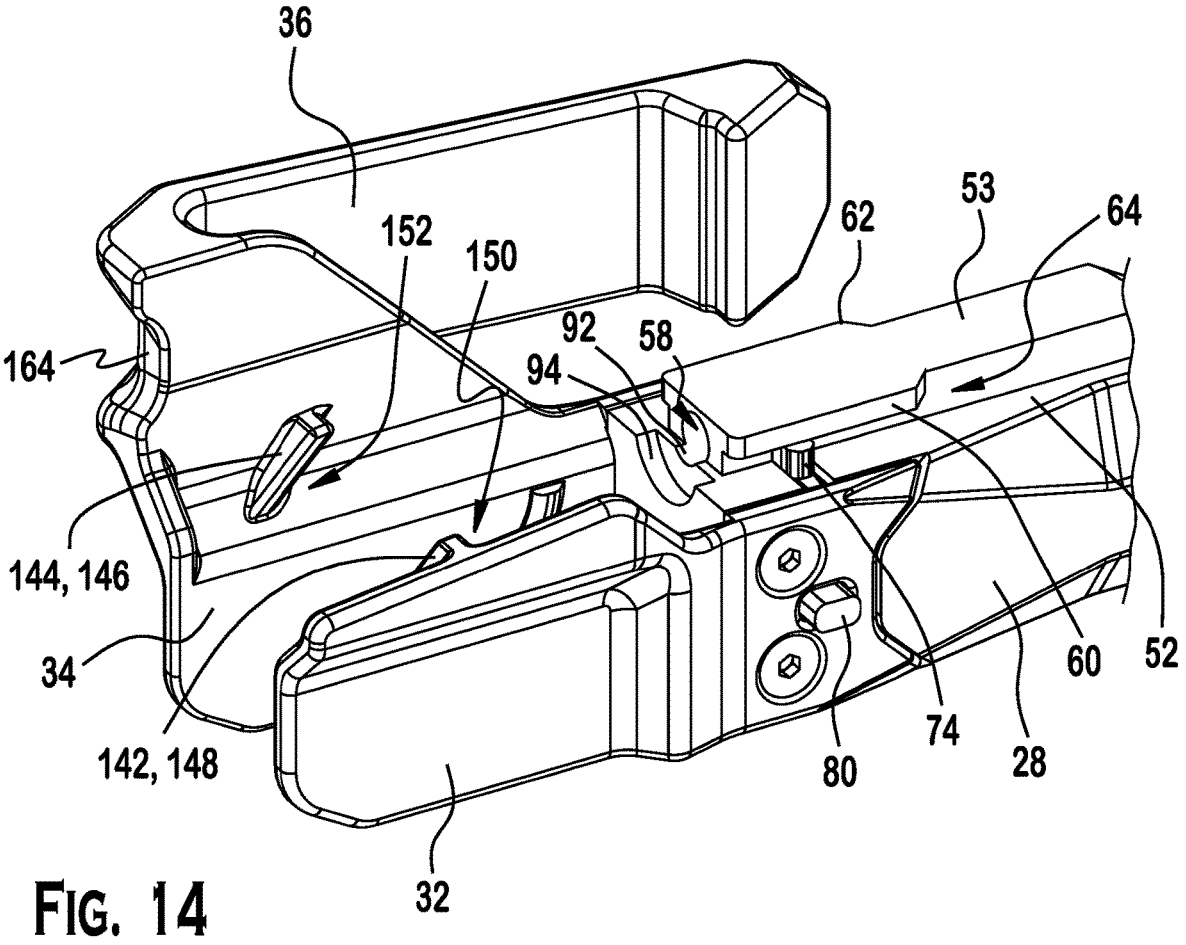
FIG. 14 is a top rear left side perspective view of the shroud and distal housing of FIG. 9.
Figure 16:
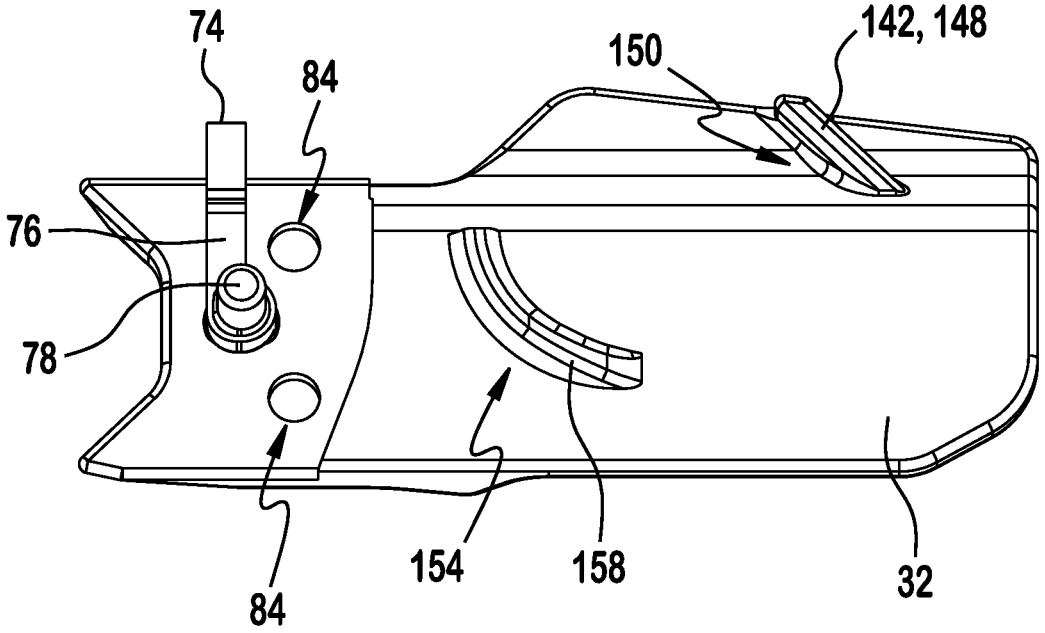
FIG. 16 is a perspective view of the interior face of the right (or starboard) wing of the shroud, along with an associated blocking member for selectively fixing the device in the deployed (or open configuration)
Figure 36:
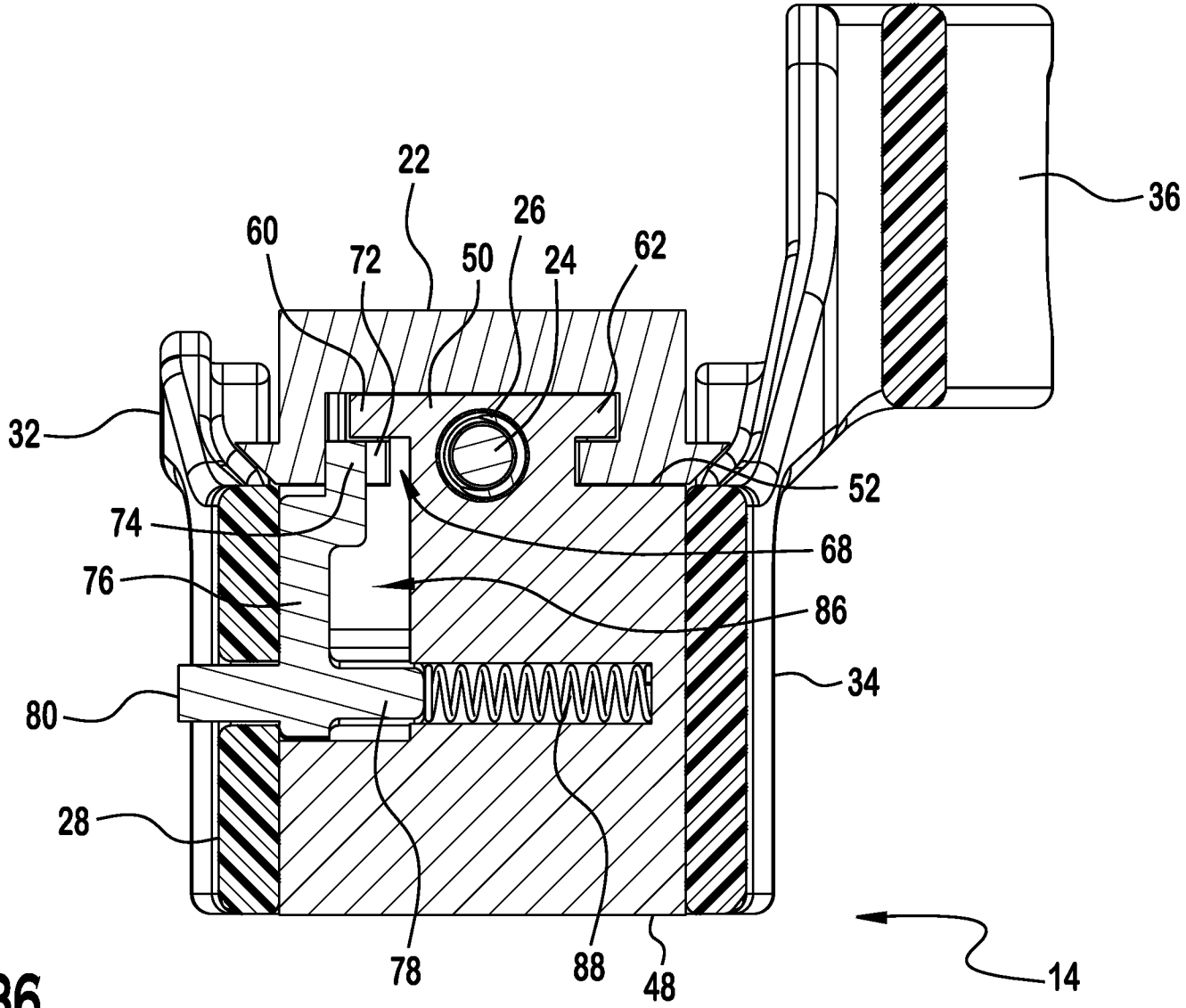
FIG. 36 is a cross-sectional view of the trigger shroud assembly of FIG. 10 along line 36-36, the trigger shroud assembly being shown in the stored (or closed) configuration.

Referring to FIG. 14, the starboard channel 64 may include a notch 68. Referring to FIGS. 14, 16 and 36, the notch 68 may house a latching member 70 that is configured and dimensioned to cooperate with a catch 72 on the rail mount 22 (FIG. 22) to selectively fix the trigger guard assembly in the open configuration 25 and the small arm apparatus 10 in the deployed configuration 25. In other embodiments, the notch 68 and the catch 72 may be associated with the port side channel 66. Referring to FIG. 16, the latching member 70 may include a blocking tip 74, a lever arm 76, a spring guide 78, and a button 79 (see e.g., FIG. 10).

Figure 12:
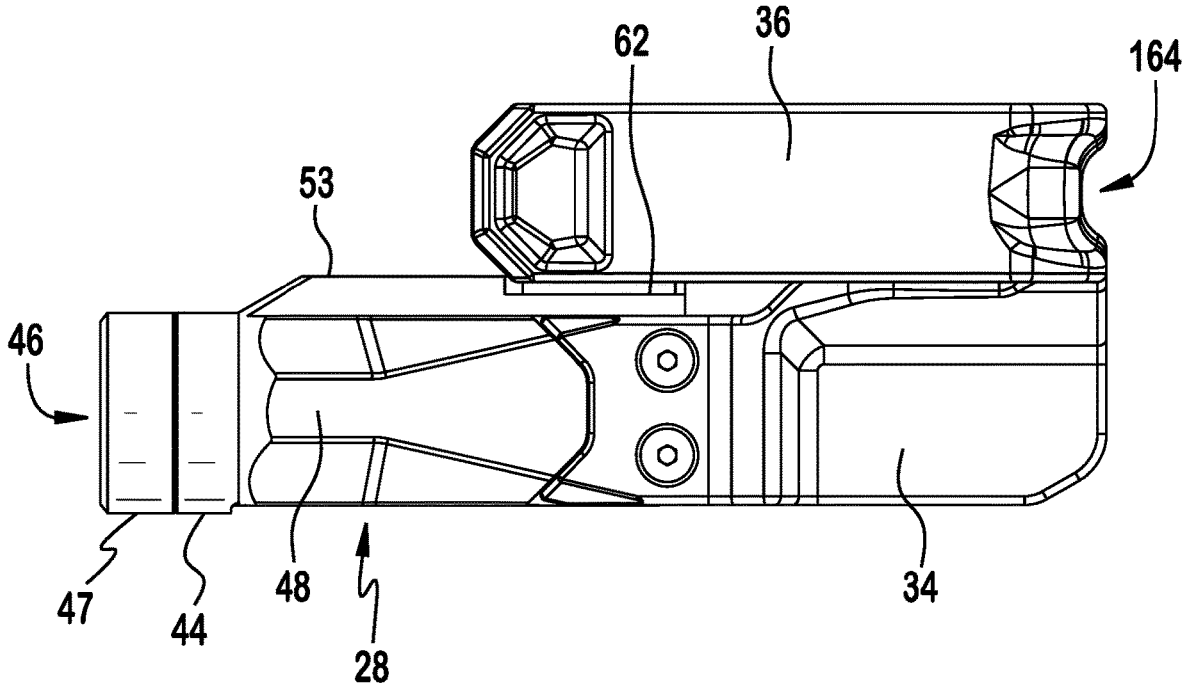
FIG. 12 is a right side view of the trigger shroud and distal housing of FIG. 9.
Figure 13:
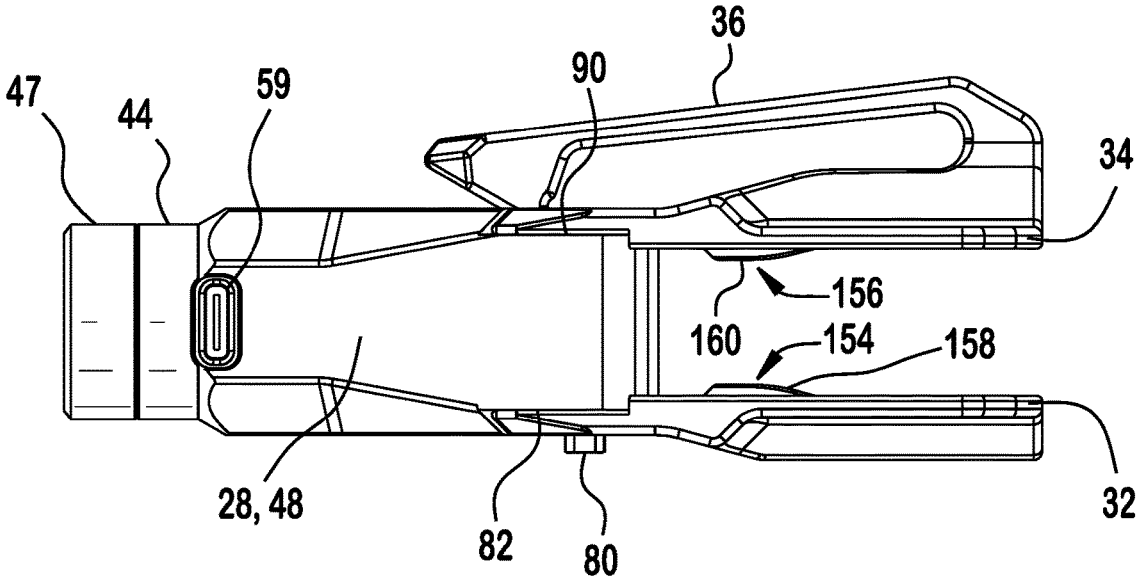
FIG. 13 is a bottom view of the trigger shroud and distal housing of FIG. 9.
Figure 15:
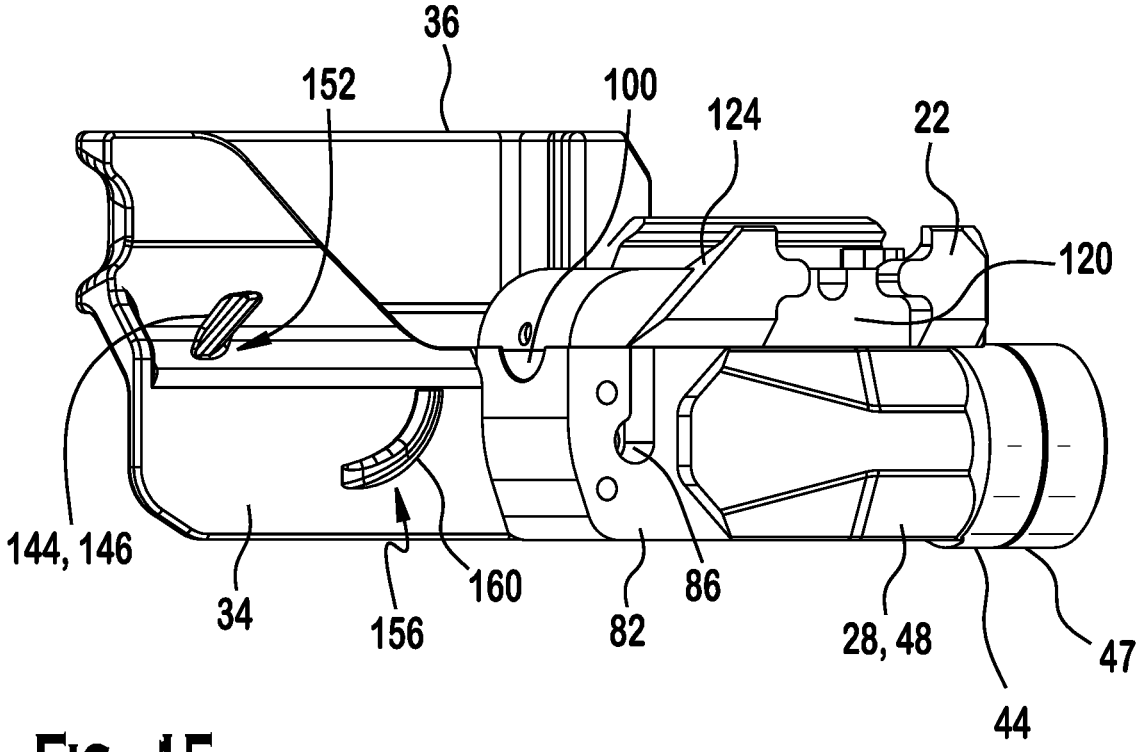
FIG. 15 is a perspective view of the shroud and distal housing of FIG. 9 with the right (or starboard) wing of the shroud disassembled from the distal housing.

As shown in FIG. 15, the inferior base portion 48 further may include a starboard keyed surface 82 adjacent to the upper surface 52. Referring to FIG. 14, FIG. 15 and FIG. 16, the starboard keyed surface 82 may be configured and dimensioned to mate with the starboard shroud 32. The starboard keyed surface 82 and the starboard shroud 32 may include fastener receiving holes 84 for fixing the starboard shroud 32 to the inferior base portion 48 of the accessory body. The starboard keyed surface 82 further may include a slot 86 for housing the latching member 70. The slot 86 may further house a compression spring 88 that seats on the spring guide 78. Referring to FIG. 6, FIG. 9, FIG. 10, FIG. 14 and FIG. 36 when assembled the compression spring 88 may bias the blocking tip 74 laterally into the starboard channel 64 and may bias the button 80 laterally away from the accessory body 28. Referring to FIG. 12 and FIG. 13, the inferior base portion 48 may further include a port keyed surface 90. The port keyed surface 90 may be configured and dimensioned to mate with the port shroud 34.

Figure 18:
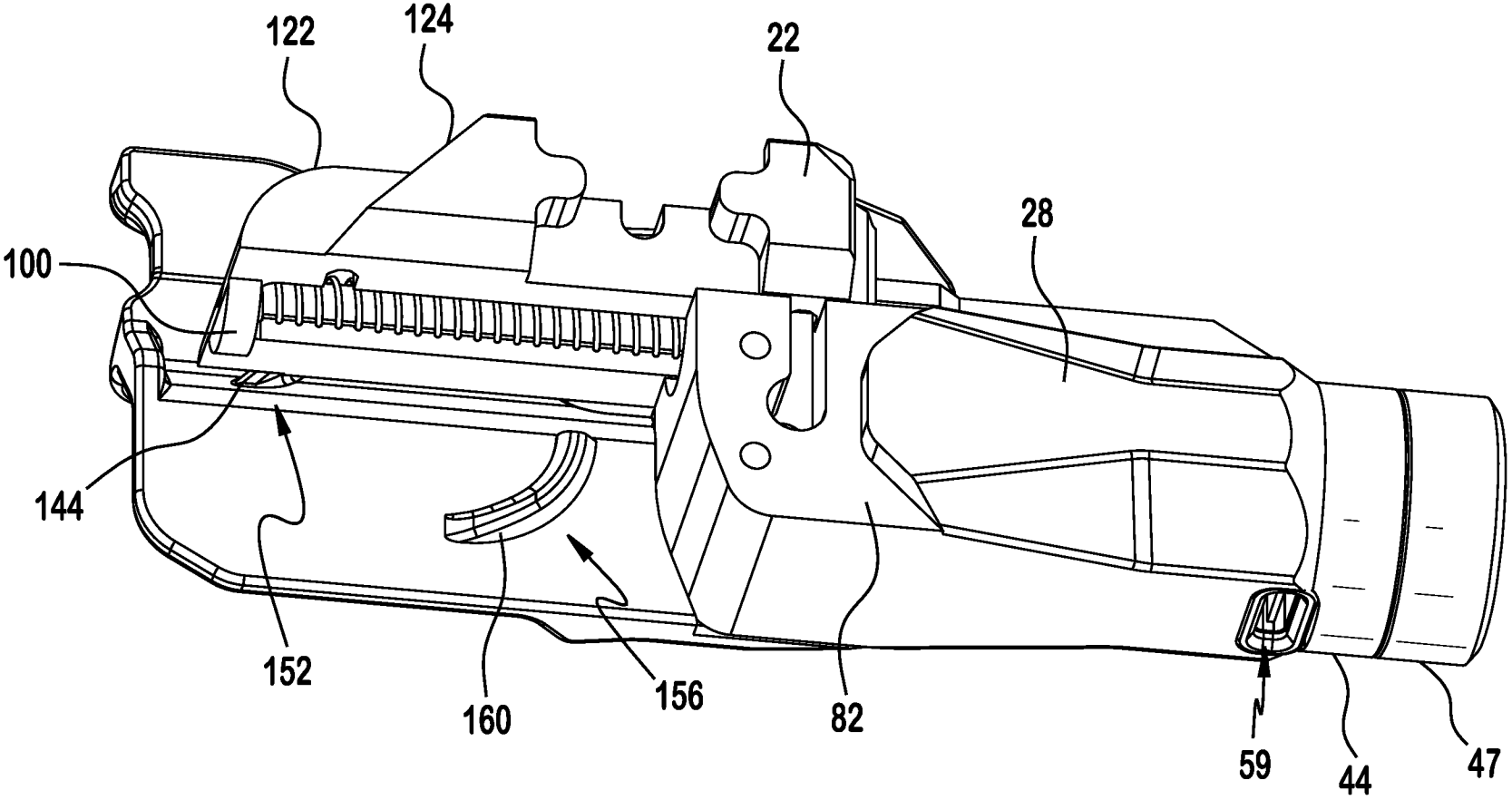
FIG. 18. is a rear left perspective view of the rail mount and the shroud and distal housing of FIG. 15, the rail mount and the shroud and distal housing being arranged to generally illustrate or correspond to their relative positions in the deployed (or open) configuration.
Figure 26:
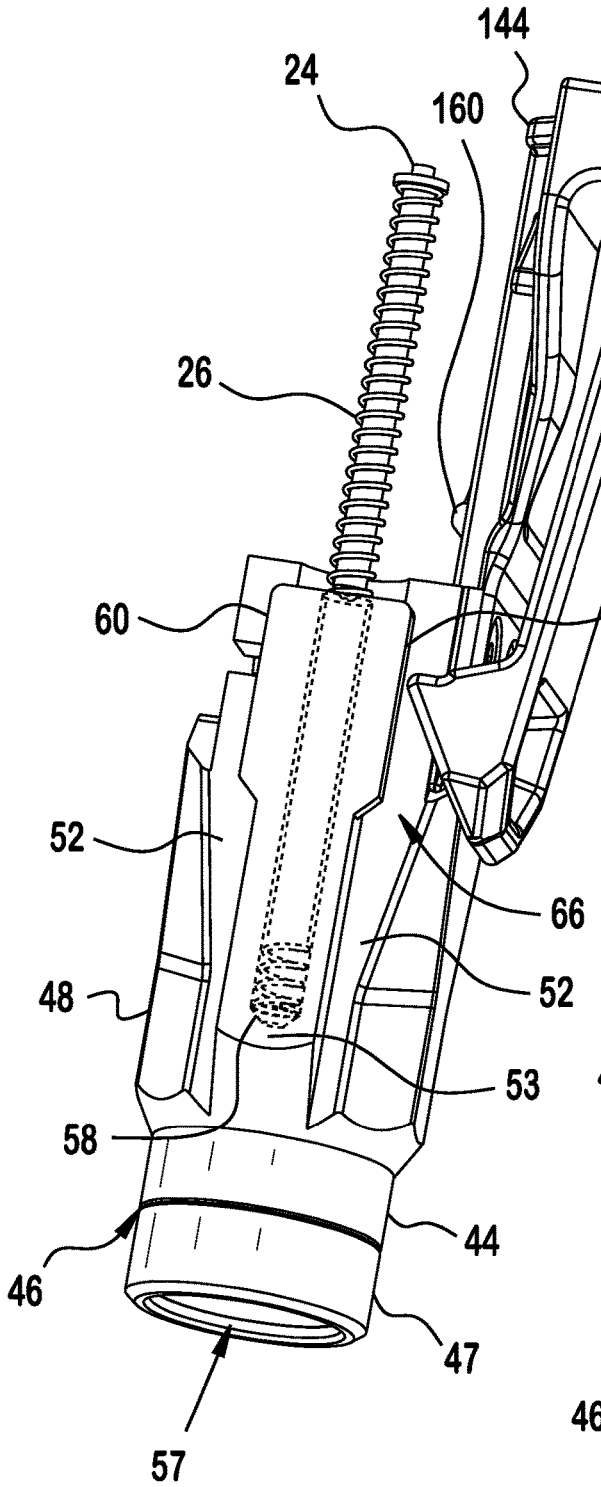
FIG. 26 is a top front perspective view of the spring guide and compression spring of FIG. 25 illustrating the compression spring being seated in an axial bore within the distal housing and the spring guide being arranged in the compression spring.
Figure 27:
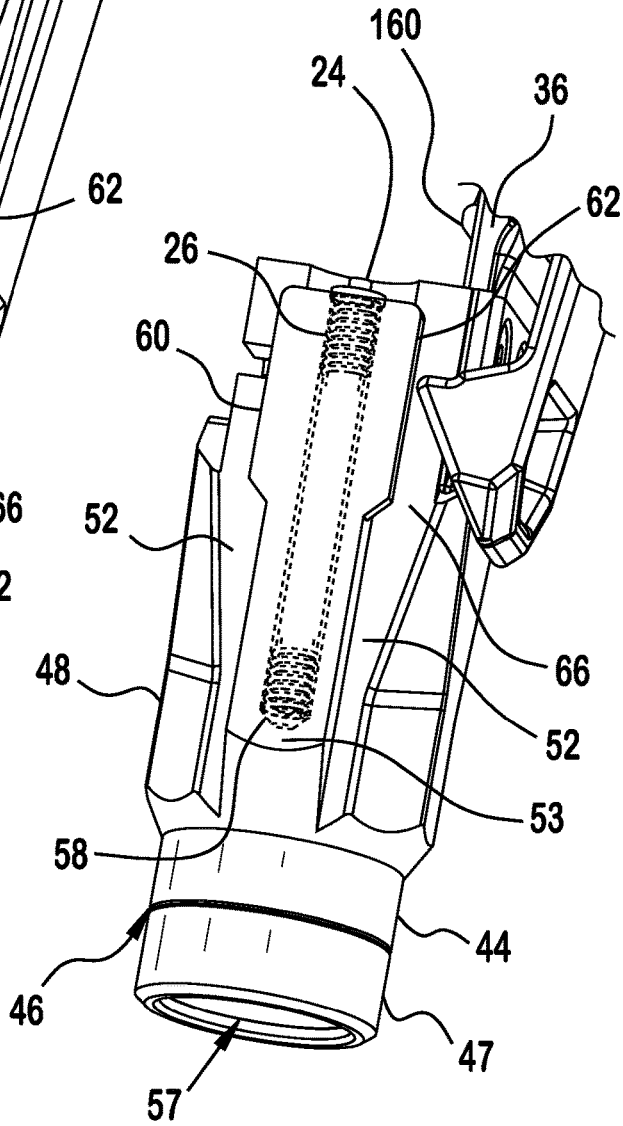
FIG. 27 is a top front right perspective view of the spring guide and compression spring of FIG. 26 illustrating the spring guide being arranged in the axial bore, the compression spring being seated in the axial bore and being compressed by the spring guide to generally illustrate or correspond to their relative positions in the stored (or closed) configuration.

Referring to FIG. 14, the upper surface 52 further may include a plurality of detents 92, 94 adjacent to the axial bore opening 96 on the rear face 54 of the superior plate portion 50. For example, a first detent 92 may adjoin the axial bore opening 96 and a second detent 94 may adjoin the first detent 92. The second detent 94 may be larger than the first detent 92. Referring to FIG. 26 and FIG. 27, the axial bore 58 and first detent 92 may each possess a cross section perpendicular to the longitudinal axis of the axial bore which is configured and dimensioned to telescopically receive the compression spring 26 and spring guide 24. Referring to FIG. 15 and FIG. 18, the second detent 94 may be configured and dimensioned to form a receptacle 98 for a tab 100 on the rail mount 22.

Figure 23:
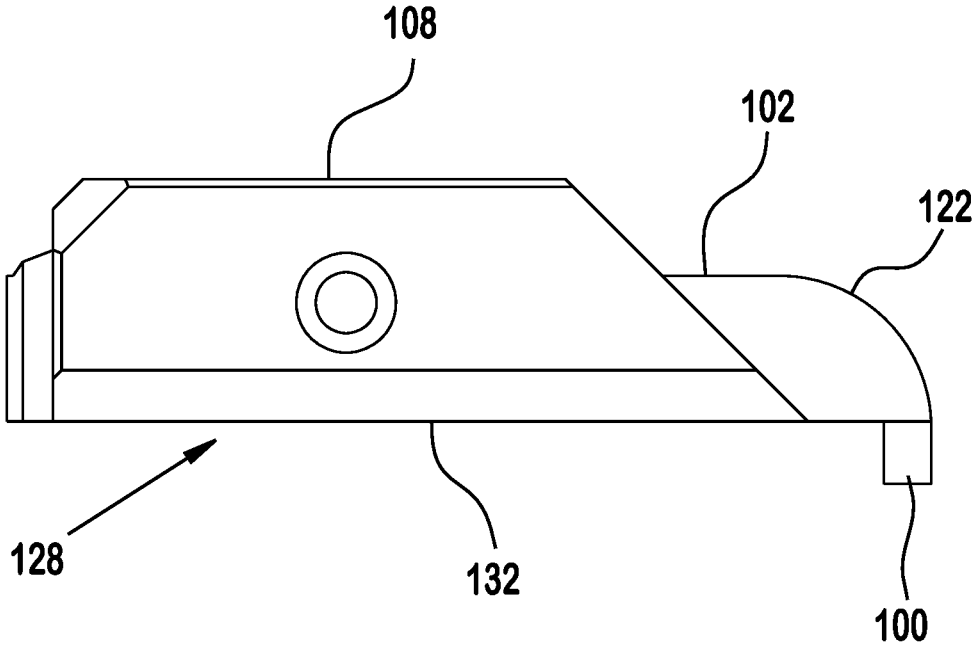
FIG. 23. is a right side view of the rail mount of FIG. 20.
Figure 24:
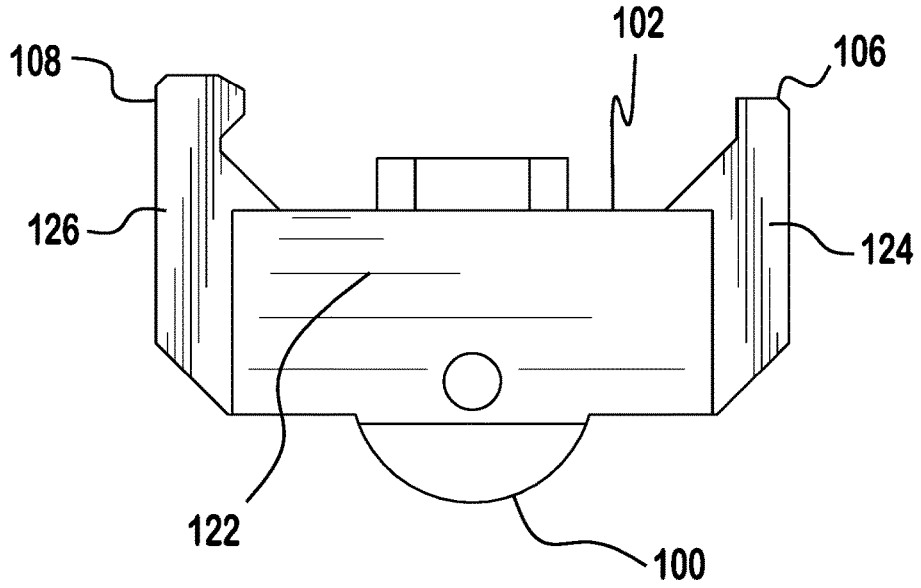
FIG. 24 is rear view of the rail mount of FIG. 20.

Referring to FIG. 23 and FIG. 24, the rail mount 22 may include an upper surface 102 (see also FIGS. 19, 21, 23 and 24) and a lower surface 104. As shown in FIG. 20, the upper surface 102 may be configured and dimensioned to slide onto and interlock with the accessory rail section 20 (e.g., a Picatinny rail) of a handgun frame 16. For example, the upper surface 102 may include a starboard rail 106 and a port rail 108 which are configured and dimensioned to attach to an accessory rail section 20.

Figure 21:
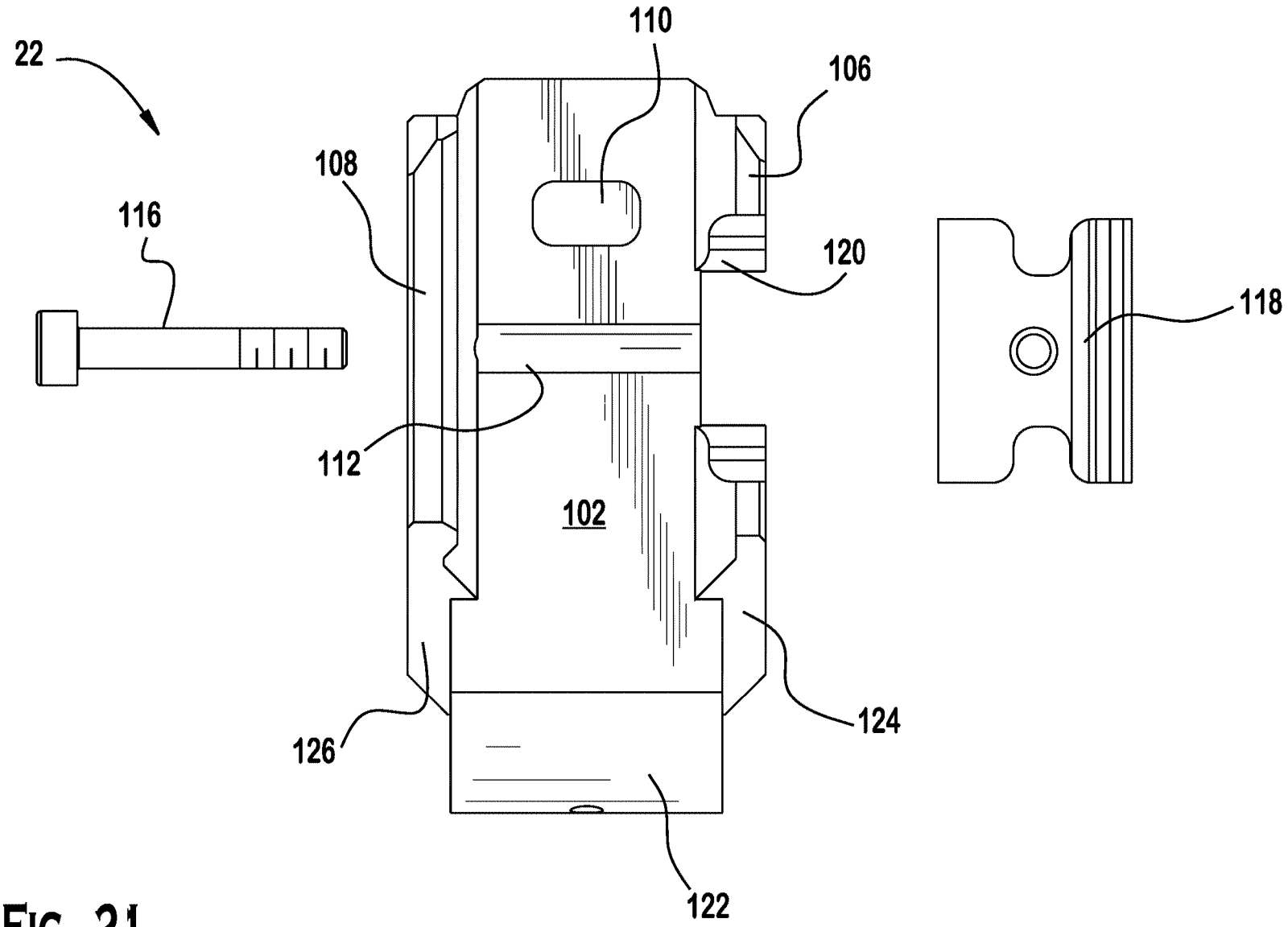
FIG. 21. is a rear right perspective view of the rail mount of FIG. 20 in a disassembled state.

Referring to FIG. 21, the upper surface 102 may include a rectangular projection 110 and a lateral notch 112 for receiving a screw clamp 114. The screw clamp 114 may include a threaded fastener 116 and a clamping member 118. The upper surface 102 further may include a ramp 120 and associated features for guiding and holding the clamping member 118 in a secure relationship with the mating accessory rail section 20 as the screw clamp 114 is tightened to fix the rail mount 22 to the accessory rail section 20.

Referring to FIG. 21 and FIG. 23, the upper surface 102 may include a curved tail segment 122. The curved tail segment 122 may have a profile that is complementary to a trigger guard for which the accessory is adapted (see e.g., FIG. 17). The upper surface 102 of the rail mount 22 may further include a starboard inclined face 124 at the rear end of the starboard rail 106 and a port side inclined face 126 at the rear end of the port rail 108.

Figure 22:
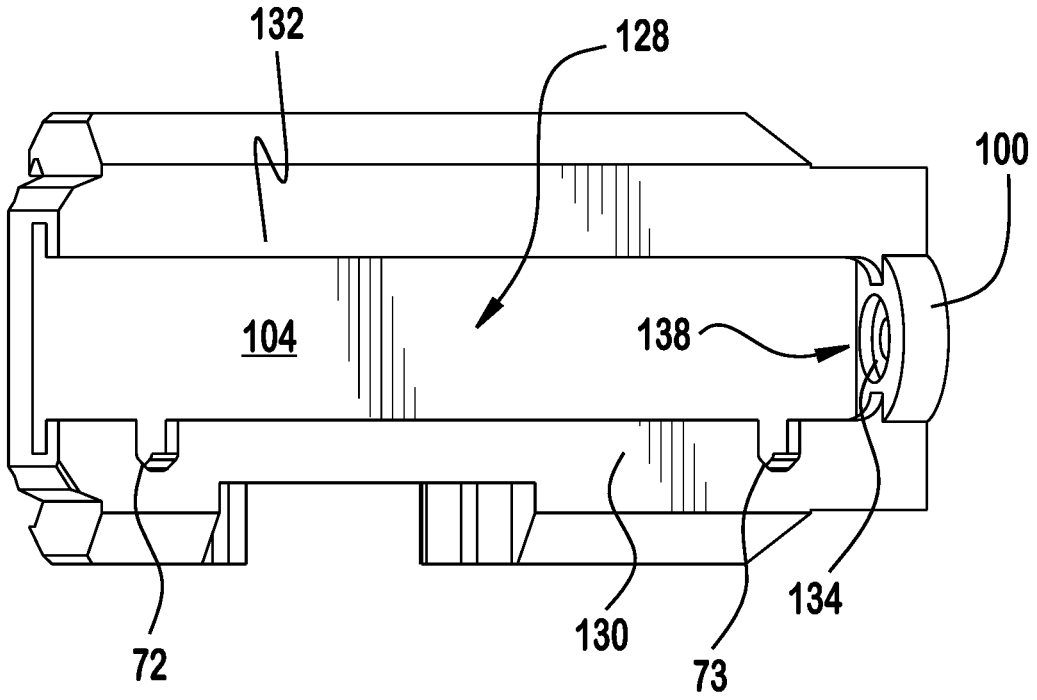
FIG. 22. is a front left side perspective view of the inferior surface of the rail mount of FIG. 20.

Referring to FIG. 22, the lower surface 104 of the rail mount may include a recessed rectangular track 128. The recessed rectangular track 128 may be bounded on the starboard side by an inferior starboard side rail 130. The recessed rectangular track 128 further may be bounded on the port side by an inferior port side rail 132. The lower surface 104 of the rail mount also may include the tab 100. The tab 100 may be adjacent to the recessed rectangular track 128, the inferior starboard side rail 130, and the inferior port side rail 132. The tab 100 may include one or more depressions 134. The one or more depressions 134 may for a counter bore 138.

Figure 28:
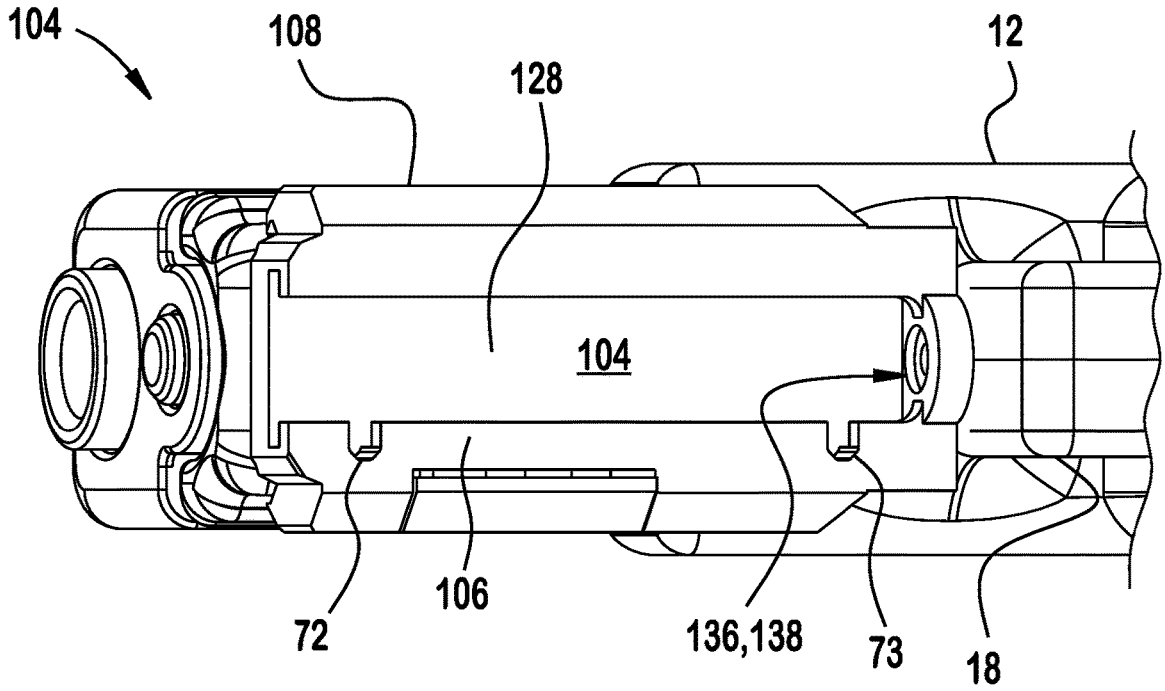
FIG. 28 is a front, right side bottom perspective view of the rail mount of FIG. 1 secured to an illustrative small arm.

Referring to FIG. 28 (compare FIG. 29), the counter bore 138 may be concentrically aligned and configured and dimensioned to form a seat for the axial spring guide 24. Referring to FIG. 22 and FIG. 28, the catch 72—which cooperates with the latching member 70—may be disposed along the inferior starboard rail 130. Referring to FIGS. 14, 15, 17 and 18, the upper surface 53 of the superior plate portion of the accessory body may be flat and smooth and configured to abut and slide against the recessed rectangular tack. The inferior starboard rail 130 may be slidably secured within the starboard channel 64, and the inferior port rail 132 may be slidably secured within the port channel 66.

As shown in FIG. 15 and FIG. 19, rearward travel of the accessory body 28 with respect to the rail mount 22 may be limited by the tab 100, which may interlock with the first detent 92 and the second detent 94 on the accessory body 28 to block translational movement. By contrast, forward travel of the accessory body 28 may be limited by the starboard inclined face 124 and the port inclined face 126 (see e.g., FIG. 22) which respectively mate with a starboard stop 142 on the starboard shroud 32 and a port stop 144 on the port shroud 34 (see e.g., FIG. 14) to block forward translational movement.

Referring to FIG. 14, FIG. 15 and FIG. 16 the port stop 144 and the starboard stop 142 may each include a projection 146, 148. The projections 146, 148 may form an oblique angled segment that is complementary to the respective port inclined face 126 and starboard inclined face 124. The oblique angled segment and the adjacent interior surface of the shroud 32, 34 may define a pocket 150, 152 which interlocks with the opposing inclined face 124, 126 to block forward movement of the accessory body. Moreover, the starboard shroud 32 and the port shroud 34 may further include a starboard latching surface 154 and a port latching surface 156, respectively. The starboard latching surface 154 and the port latching surface 156 may each include a curved ridge 158, 160 which is positioned on the interior surface of each respective shroud 32, 34 so as to engage with the trigger guard 18 to restrain forward motion of the accessory body (see e.g., FIG. 13 and FIG. 17).

A secondary locking or restraining system may be incorporated into the trigger shroud assembly to further deter an unintentional release of the catch. For example, as shown in FIG. 22, a second catch 73 may be positioned on the inferior starboard rail 130 adjacent to the tab 100 to allow the blocking tip 74 and the second catch to interlock, fixing translational movement of the accessory body with respect to the rail mount, and thus locking the trigger shroud assembly 14 in the closed configuration 27.

Figure 17:
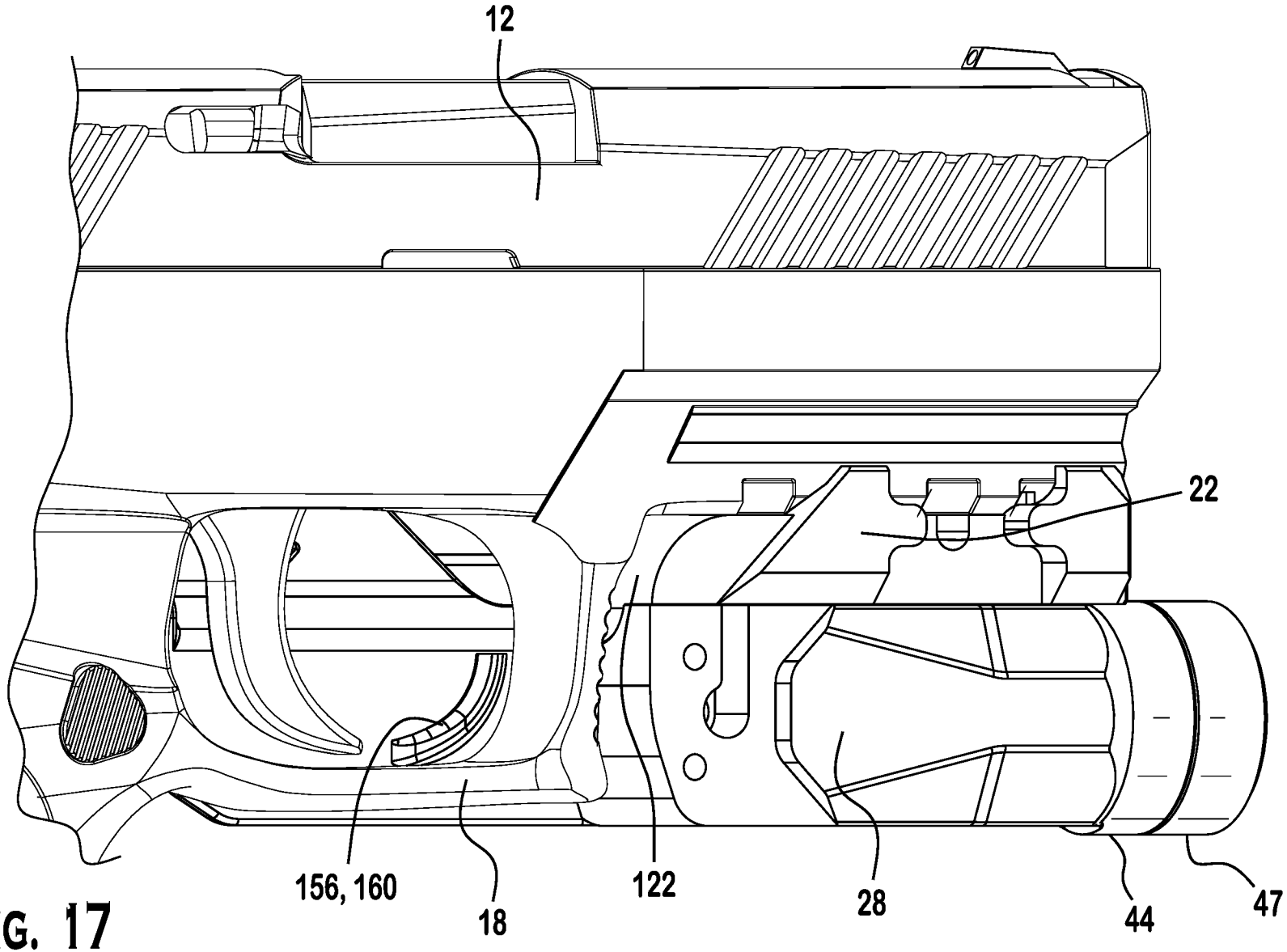
FIG. 17. is a perspective view of an illustrative trigger guard of a pistol in relation to the rail mount, left wing of the shroud, and the distal housing of FIG. 9 in the stored (or closed) configuration.
Figure 25:
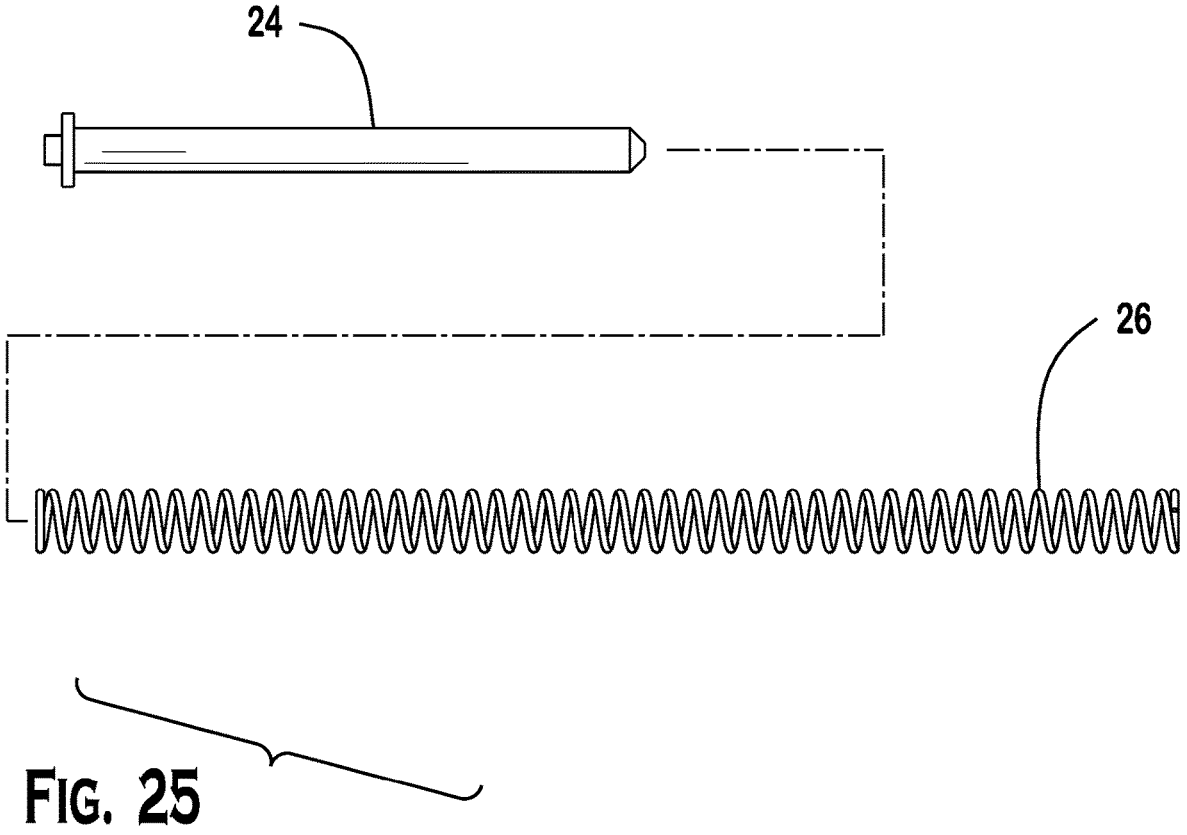
FIG. 25 is a side view of the spring guide and compression spring of FIG. 5.
Figure 29:
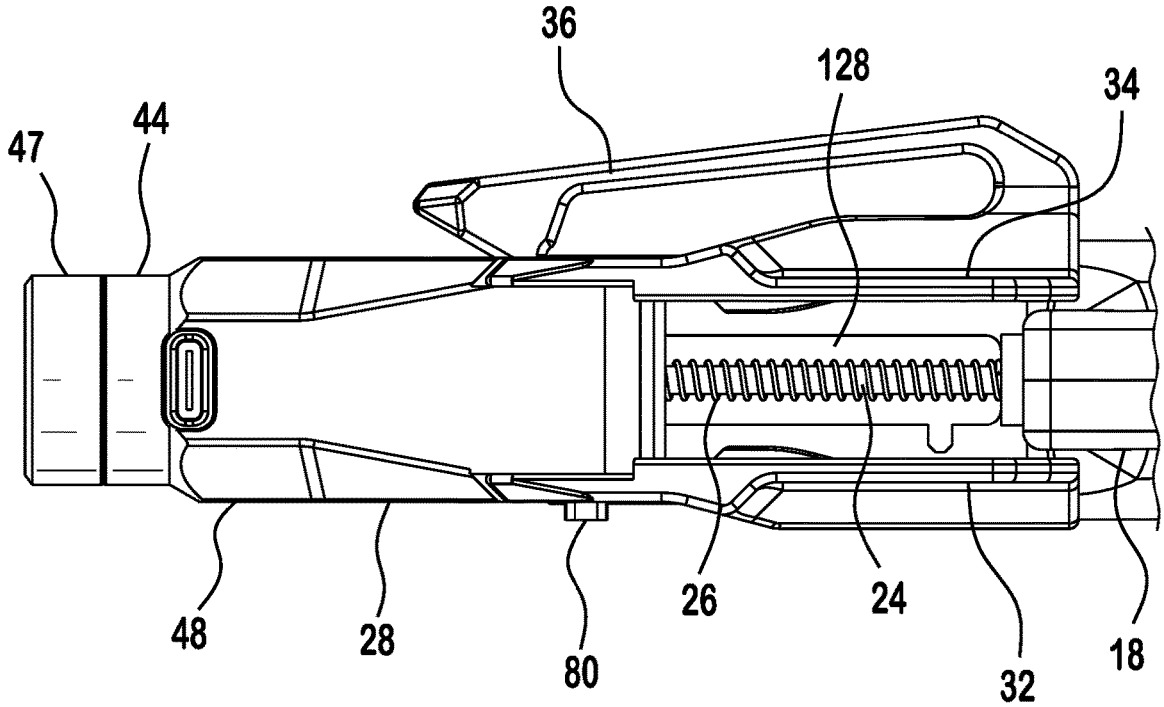
FIG. 29 is a perspective view of the trigger shroud assembly of FIG. 1 secured to the rail mount of FIG. 28, the small arm apparatus (and trigger shroud assembly) being in the deployed (or open configuration)
Figure 32:
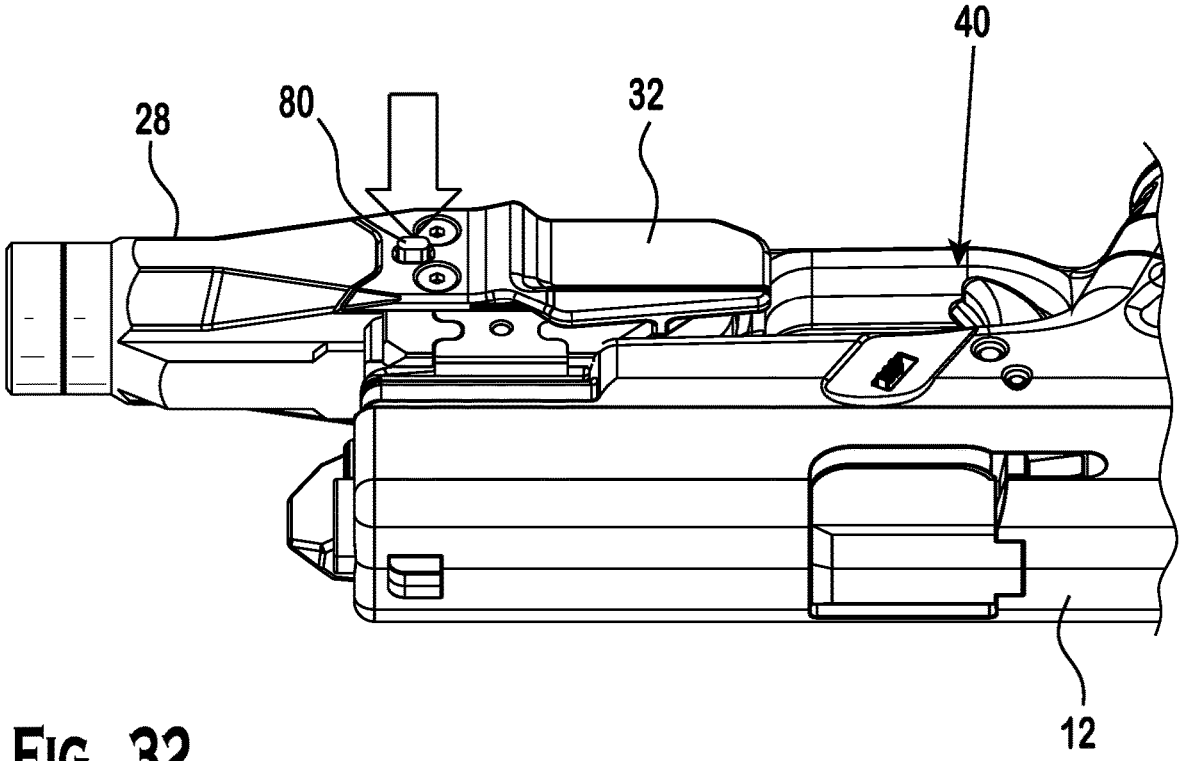
FIG. 32 is a perspective view of an operator of the small arm apparatus of FIG. 29 selectively unfixing the apparatus from deployed (or open configuration)

Referring to FIG. 8, the small arm apparatus 10 may be assembled by securing the rail mount 22 to the accessory rail section 20 of the frame 16 (FIG. 28). Referring to FIG. 25, the axial compression spring 26 may be arranged on the axial spring guide 24. As shown in FIG. 26 and FIG. 27, the axial compression spring 26 and axial spring guide 24 subassembly may be arranged in the axial bore 58. The axial spring guide 24 may be seated in the tab 100 (FIG. 29). The button 80 of the latching member 70 may be depressed (FIG. 32). The superior plate portion 50 of the accessory body 28 may be coupled to the lower surface 104 of the rail mount 22 by sliding the inferior starboard rail 130 into the starboard channel 64 and sliding the inferior port rail 132 into the port channel 66 until the starboard latching surface 154 and the port latching surface 156 ride over and catch onto the trigger guard 18 (FIG. 17 and FIG. 36).

Referring to FIG. 7, FIG. 11 and FIG. 13, the accessory body may include an accessory 47, such as a flashlight or other powered device(s). The flashlight or other powered device(s) may be housed in the receptacle 46 at the distal end of the accessory body 28. The flashlight or other powered device(s) may be activated in the deployed configuration 25. Further, the powered device may be deactivated in the stored configuration. This may be accomplished by a mechanical switch and/or electronic circuit. The flashlight or other powered device(s) may be activated or deactivated manually, automatically or in some combination thereof. For example, the power supply to the flashlight may be turned on/off by rotating the head of the flashlight to provide full manual control over operation of device. Additionally, a secondary mechanical switch, electrical control circuit, and/or electronic control circuit may be implemented to automatically activate or deactivate the powered device.

Figure 30:
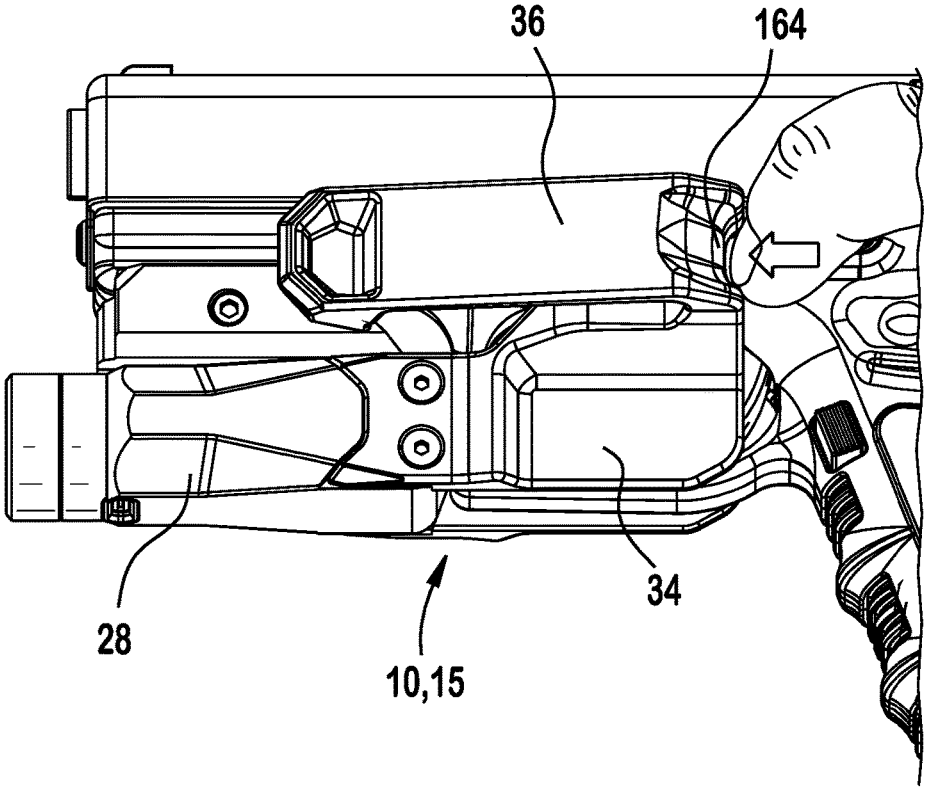
FIG. 30 is a perspective view of an operator of the small arm apparatus of FIG. 29 selectively releasing the apparatus from the stored (or closed) configuration.
Figure 31:
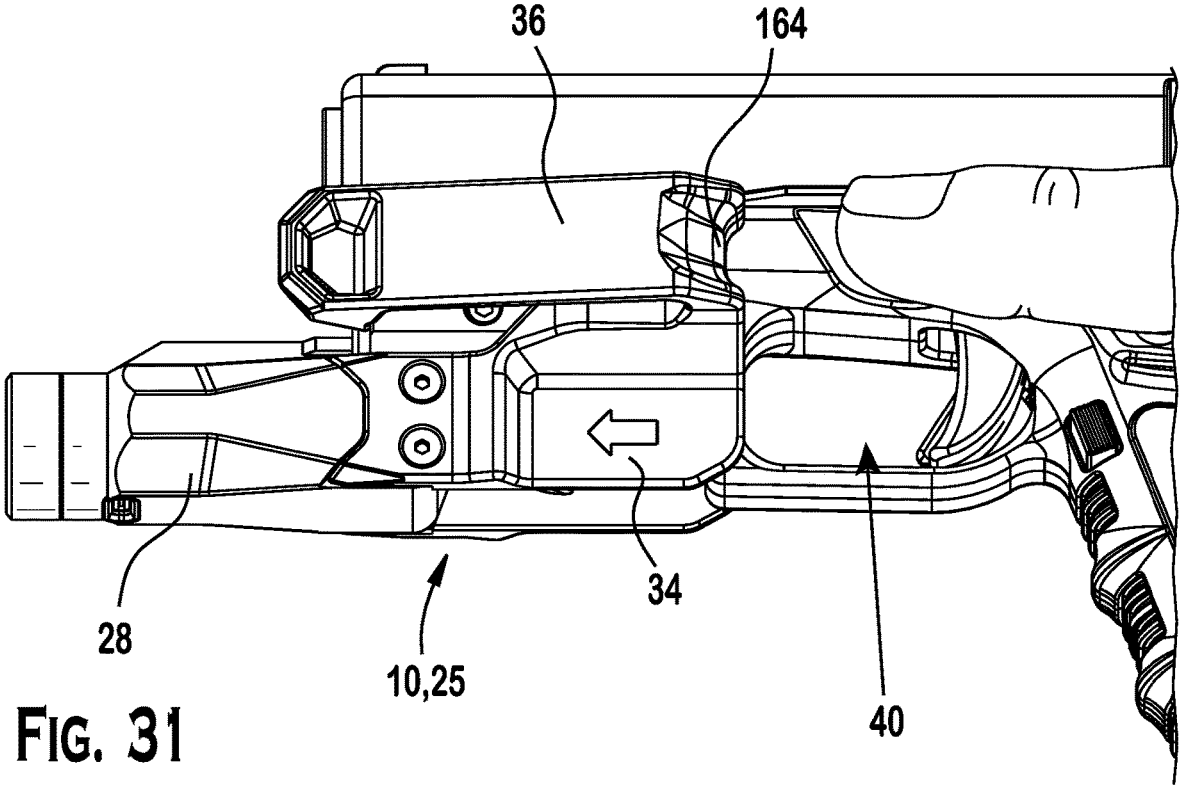
FIG. 31 is a perspective view of the small arm apparatus of FIG. 29 fixed in the deployed (or open configuration)

In use, the small arms apparatus may be carried in the stored configuration, in which the trigger guard openings may be covered by the trigger shroud to isolate the trigger, and thus prevent inadvertent activation of the trigger (see e.g., FIG. 1, FIG. 2 and FIG. 3). The small arms apparatus may be removed from a carry location and the index finger of the dominant hand of the operator may be used to release the catch by moving the starboard latching surface and the port latching surface forward and over the trigger guard (FIG. 30). Alternatively, a mechanical or electromechanical device may be activated by the operator to release the catch. In the disclosed embodiment, the belt clip may include a concave shape 164 for receiving the tip of the index finger of the operator (FIG. 2 and FIG. 30). The concave shape or scalloped recess on the belt clip may provide a tactile indication to the user that the tip of the index finger has made contact with the belt clip. The concave shape or scalloped recess further may prevent the index finger of the operator from slipping off the belt clip as the shroud is pushed forward to release the catch (FIGS. 30 and 31).

After the catch is released, the axial compression spring may push the accessory body forward with respect to the rail mount and trigger guard until the starboard inclined face and the port inclined face respectively engage with the starboard stop on the starboard shroud and the port stop on the port shroud to block forward translational movement (FIG. 4, FIG. 5, FIG. 6 and FIG. 7). In this arrangement, the blocking tip may be positioned opposite the catch (e.g., a cut, notch or hollow) on the inferior starboard rail. Further, the transverse compression spring may bias the latching member away from the accessory body and position the blocking tip into the catch. The blocking tip and the catch may interlock to fix translational movement of the accessory body with respect to the rail mount, locking the trigger shroud apparatus in the open configuration and small arm apparatus in the deployed configuration.

Figure 33:
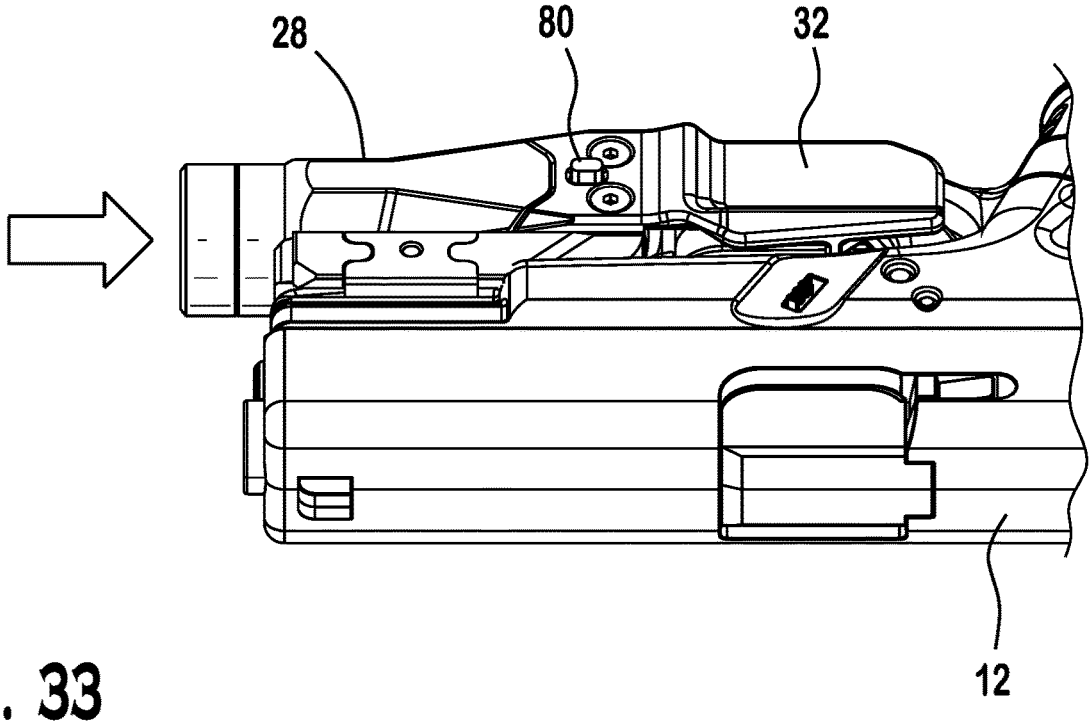
FIG. 33 is a perspective view of an operator of the small arm apparatus of FIG. 29 moving the apparatus from a deployed (or open) configuration to the stored (or closed) configuration.

The operator may depress the button to remove the blocking tip from the catch to unfix translational movement of the accessory body with respect to the rail mount (see e.g. FIG. 32), and thereby unlock the trigger shroud apparatus from the open configuration and the small arm apparatus from the deployed configuration. The operator may then reposition the accessory body and trigger shroud about the trigger guard opening (see e.g., FIG. 33) until the starboard inclined face 124 and the port inclined face 126 (see e.g., FIG. 22) respectively mate with the starboard stop 142 on the starboard shroud 32 and the port stop 144 on the port shroud 34 (see e.g., FIG. 14) to block forward translational movement.

While it has been illustrated and described what at present are considered to be preferred embodiments of the present invention, it will be understood by those skilled in the art that various changes and modifications may be made, and equivalents may be substituted for elements thereof without departing from the true scope of the invention. For example, the shape, materials of construction, and spring force of the coil springs may be adapted for use with a particular geometry. Additionally, features and or elements from any embodiment may be used singly or in combination with other embodiments. Therefore, it is intended that this invention not be limited to the particular embodiment(s) disclosed herein, but that the claims include all embodiments falling within the scope and spirit of the present invention.

What is claimed is:

1. A trigger shroud assembly for a firearm having a frame that includes an accessory rail and a trigger guard, the trigger shroud assembly comprising:

a rail mount which comprises a block comprising a superior portion which is configured and dimensioned to interlock with the accessory rail of a handgun frame, the superior portion comprising a planar surface that is configured and dimensioned to mate with the accessory rail of a handgun frame, a starboard rail adjacent the planar surface, a port rail opposite the starboard side rail, and a clamp for securing the superior portion to the accessory rail, and an inferior portion which comprises an inferior starboard side rail which comprises a first inclined face, an inferior port side rail which comprises a second inclined face, a tab adjacent to the starboard side rail and the port side rail, and a recessed track abutting the inferior starboard side rail, the inferior port side rail, and the tab, a catch on one of the starboard side rail or the port side rail;

an accessory body slidably connected to the inferior portion;

a spring guide disposed between the tab and the accessory body;

a resilient member arranged about the spring guide;

a starboard side trigger shroud connected to the accessory body, the starboard side trigger shroud comprising a starboard stop; and a port side trigger shroud connected to the accessory body, the port side trigger shroud comprising a port side stop, and a belt clip disposed on the other one of the starboard side rail or the port side rail;

the trigger shroud assembly comprising a stored configuration and a deployed configuration such that in the first configuration the accessory body is adjacent to the tab, and in the second configuration the starboard stop is adjacent to the first inclined face, the port side stop is adjacent to the second inclined face, and the resilient member biases the accessory body away from the tab.

2. The trigger shroud assembly of claim 1, wherein the accessory body further comprises a receptacle for receiving a tactical accessory.

3. The trigger shroud assembly of claim 2, wherein the receptacle is configured and dimensioned to house a flashlight.

4. The trigger shroud assembly of claim 3, wherein the flashlight emits light in the deployed configuration.

5. The trigger shroud assembly of claim 4, wherein the flashlight does not emit light in the stored configuration.

6. A small arms apparatus comprising:

a firearm which comprises an accessory rail, a trigger, and a trigger guard adjacent the trigger; and a trigger shroud assembly of claim 1 secured to the accessory rail.

7. The small arms apparatus of claim 6, wherein in the stored configuration the trigger is arranged between the starboard side trigger shroud and the port side trigger shroud, and in the deployed configuration the starboard side trigger shroud and the port side trigger shroud are biased away from the trigger.

8. A method of deterring inadvertent activation of a handgun, the method comprising:

providing a trigger shroud assembly of claim 1;

securing the trigger shroud assembly to the handgun; and arranging the trigger shroud assembly into the stored configuration.

* * * * *